US005956785A

United States Patent [19]

Fireman

[11] Patent Number: 5,956,785

[45] Date of Patent: Sep. 28, 1999

[54] LOCKABLE TWO FRAME CONVERTIBLE SOFA BED

[76] Inventor: Robert Fireman, 785 Westend Ave. #7B, New York, N.Y. 10025

[21] Appl. No.: 08/621,559

[22] Filed: Mar. 25, 1996

Related U.S. Application Data

[63] Continuation-in-part of application No. 08/164,443, Dec. 9, 1993, Pat. No. 5,509,151.

[51] Int. Cl.[6] ..... A47C 17/17; A47C 17/04

[52] U.S. Cl. ..... 5/37.1; 5/47

[58] Field of Search ..... 5/37.1, 41, 47

[56] References Cited

U.S. PATENT DOCUMENTS

| | | | |
|---|---|---|---|
| 715,114 | 12/1902 | Mooers . | |
| 1,982,930 | 12/1934 | Russo | 5/37.1 |
| 2,244,470 | 6/1941 | Neunmerz | 5/38 |
| 2,294,475 | 9/1942 | McAllister | 5/47 |
| 2,769,987 | 11/1956 | Thal | 5/37.1 |
| 3,634,893 | 1/1972 | Mern et al. | 5/37.1 |
| 4,642,823 | 2/1987 | Wiggins | 5/47 |
| 4,829,611 | 5/1989 | Firbman et al. | 5/47 |
| 4,875,244 | 10/1989 | Tremblay | 5/37.1 |
| 4,996,730 | 3/1991 | Firbman et al. | 5/37.1 |
| 5,083,333 | 1/1992 | Newton | 5/37.1 |
| 5,170,519 | 12/1992 | Meade | 5/37.1 |
| 5,664,268 | 9/1997 | Stoler et al. | 5/37.1 |

*Primary Examiner*—Alexander Grosz
*Attorney, Agent, or Firm*—Richard B. Klar

[57] ABSTRACT

A two frame sofa bed recliner has a seat frame, a back frame, and a pair of arm frames connected to both sides of the recliner. Vertical and horizontal slots are located in each of the arm frames. A first pin connected to a side of an upper portion of the back frame extends into the vertical slot. A second pin connected tog a lower portion of a side of the back frame extends into the horizontal slot. The pins move along the slots to guide the recliner from an upright to a fully reclined position and vice verse. An enlarged corner of the vertical slot securely engages the first pin when the recliner is in the fully reclined position preventing the recliner from jackknifing upward. Counter absorbing elements are fixedly attached to the side of the seat frame absorbs stress or pressure from the slots as the pins move therein and this stress is transferred uniformly along the attached surface of the seat frame.

16 Claims, 24 Drawing Sheets

LOCKABLE TWO FRAME CONVERTIBLE SOFA BED

BACKGROUND OF THE INVENTION

The present invention is a continuation in part application of U.S. patent application Ser. No. 08/164,443 filed on Dec. 9, 1993 now U.S. Pat. No. 5,509,151. Priority of U.S. patent application Ser. No. 08/164,443 is claimed herein under U.S.C. 120. The present invention is a two frame assembly sofa bed recliner having a simple interlock between the seat frame assembly and the back frame assembly. The sofa bed recliner has removable arm rests. In another embodiment the arm rests or side arms and the back frame are connected by guide means for guiding the recliner from a fully upright position to a fully reclined position and vice verse. The recliner may be made of either wood or metal.

The present invention is a unique combination of many elements including some known in the art to provide an inexpensive to produce, easy to use, space saving, sturdy light weight, two frame assembly sofa bed recliner preferably made of wood or metal with an improved structure and case of conversion and reconversion over the prior art.

In converting from a recliner to a sofa bed it is preferable to have the arm rests disengaged. To convert from recliner to a sofa bed the engaged back frame assembly and seat frame assembly are moved upward from the recliner position. The back frame assembly allowing the seat frame assembly once horizontal on the floor is unlinked from the seat from assembly allowing the seat from assembly to be lowered to a horizontal position and locked against jackknifing. The structure has the advantage of being able to simply interact to transform from recliner to sofa bed.

The arm rests are engagable to the back frame assembly and seat frame assembly once the sofa bed recliner is in recliner position.

The seat frame assembly and back frame assembly are pivotally linked free of any main frame and when in horizontal position support themselves elevated from the floor.

A simple system is provided for reconverting the sofa bed to a recliner position. The seat frame assembly is pulled backward disengaging it from its locked position, then lifted to a substantially vertical position. The seat frame assembly and back frame assembly are then interlockable for simultaneous rotation to a recliner position.

In a preferred embodiment of the present invention, the length and width of the back frame assembly and the seat frame assembly are such that, when opened into a sofa bed horizontal position, the bed portion is like a full double bed or larger.

The present invention is particularly adapted for use with a futon. Futons have become popular, offering the advantage of convertible structure adaptable for both sitting and sleeping. The present invention acts as a support structure for a futon, having the combined advantage of being a sturdy sofa bed and recliner.

The present invention has the advantage of the space saving of a futon supported on a structure, which also saves space. The futon serving as a recliner cushion and as a mattress. The simplicity of the structure is economical without sacrificing utility. As a recliner there is no separate main frame, as a sofa bed the seat frame assembly and back frame assembly are properly supported without special supporting parts.

The elements are simplified over the prior art, combined and improved to provide a simple to construction, inexpensive to produce, easy to use two frame assembly sofa bed recliner.

The present invention also is a simple alternative for U.S. Pat. No. 4,829,611. The sofa bed recliner provides an inexpensive simple means for the seat frame assembly and back frame assembly to interengage to easily convert and reconvert to a sofa bed position and to a recliner position. Lifting of the seat frame assembly to a substantially vertical position enables easy interengaging of the seat frame assembly and back frame assembly are rotated upward again from the recliner position, then the seat frame assembly is disengaged from the back frame assembly and moved downward.

The structural simplicity is enabled by a slot in the seat frame assembly and the configuration of the bases of the seat frame assembly and back frame assembly and the slot in the seat frame assembly which enables locking in both recliner and sofa bed positions.

The present invention also provides embodiment in which the armrests or side arms have grooves or slots therein for by pins extending from upper and lower portions of the back frame. To guide means provide a mechanism for shifting the position of the recliner from an upright vertical position to a fully reclined position and vice verse. Securing means are further provided to prevent the recliner from jackknifing up from its fully reclined position when some places pressure or weight on it. Further a counter absorbing element is provided on each side of the recliner and is tightly affixed therein to release pressure or stress on the grooves or slots during the shifting of the recliner from one position to another.

U.S. Pat. No. 4,829,611 to Fireman, et.al, applicant of the present invention and co-inventor of this cited patent, discloses a "kicker" or detent. However, this patent does not teach counter absorbing elements nor address the problem of relieving stress on the slots by uniformly distributing the stress or pressure along a surface of the recliner's frame as does the present invention. Further, the present invention provides securing means to prevent the aforementioned jackknifing by the recliner.

DESCRIPTION OF THE PRIOR ART

The prior art is replete with complex two piece structures for sofa beds mounted on main frames where the seat frame and back frame may be laid flat for use as a bed. Exemplary of such structures are U.S. Pat. No. 2,796,987 and U.S. Pat. No. 1,982,930 where complex structures convert the back frame of the sofa bed recliner from the recliner to a usable bed.

A relatively simple structure, as disclosed in U.S. Pat. No. 715,114 still requires support arms and an awkward pushing to have the seat frame and back resume their prior position and does not have the uncomplicated engaging means of the present invention.

U.S. Pat. No. 4,875,244 discloses a sofa bed recliner with a seat frame and back frame mounted on a base. The back frame has support arms. The seat frame and back frame have a complex tether spring and counter absorbing element mechanism, which enables a seat frame and back frame interlock. The seat frame and back frame also have a complex interlock when in the horizontal position, so that there is no likelihood of jackknifing.

U.S. Pat. No. 4,875,244 discloses another interlock system for reconverting a main frame wooden sofa bed recliner including guide means and a bell like tent.

U.S. Pat. No. 3,634,893 discloses a metal track system for a hinged three piece sofa bed recliner with a pivotal free floating bell shaped tent interactable with a metal reaction plate. A support arm for the back frame enables conversion of the sofa bed, including a main frame, from a sofa bed to a recliner. The seat frame is supported on legs.

U.S. Pat. No. 2,244,470 discloses a sofa bed on a low main frame with a back having a bracket to provide a two position lock for a back frame. The back frame has a hinged support and a typical wheel arrangement. The back frame has a pivot stud with a notch to engage a separate bracket spaced from the main frame by means of rivets and a collar. The bracket has a right angulated projection for receiving the notch and a vertical guide for receiving the pivot. All locking and movement is an interaction between the bracket and the notched pivot.

U.S. Pat. No. 4,829,611 provides a pivotable tent for interlocking a main frame mounted seat frame and back frame. The patent discloses a complex multi-groove guiding system in an end support leg for the seat frame and back frame and means for locking against jackknifing when the wooden sofa bed recliner is in its horizonal position.

U.S. Pat. No. 2,294,475 provides a pivotable metal plate set for interlocking a main frame mounted seat frame and back frame. The patent discloses a complex multi-groove guiding system and a groove for in an end support.

U.S. Pat. No. 5,083,333 discloses a sofa bed recliner mounted on a base. The back frame has support arms. The seat frame and back frame have complex ends with grooves and notches and pins which enable a seat frame and back frame interlock. The seat frame and back frame also have an interlock when in the horizontal position, so that there is no likelihood of jackknifing. There are grooves and guide followers in the end frames enabling the conversion and reconversion. A camber on the back frame's end plate guides pins to selected lock notches enabled by the seat frame's end plate groove.

A BRIEF SUMMARY OF THE INVENTION

The present invention is a simple convertible wooden sofa bed having only a seat frame assembly and back frame assembly. The frame assemblies are pivotally linked at extending portions which overlap, for the converting and reconverting from sofa bed to recliner. The seat frame assembly and back frame assembly include wide support beams which serve to elevate them from the floor. The wide support beam for the back frame assembly elevates it from the floor when the sofa bed recliner is in sofa bed horizontal position or during reconversion. The support beams overlap and link the back frame assembly and end frame assembly with interactive pivots, pins, a groove and a notch at their overlap portions. The overlap portions interlock and can interlock to prevent jackknifing when the sofa bed recliner is in horizontal position.

From the recliner position the seat frame assembly and the back frame assembly may be rotated backward so that the back frame assembly rests on the floor for conversion from recliner to sofa bed horizontal position and reconversion back to recliner position.

In a preferred embodiment detachable arm rests are optionally engagable with the sofa bed recliner of the present invention for additional comfort and convenience.

According to the present invention, a sofa bed recliner has a seat frame and back frame. Each frame has supports. The supports have portions extending beyond the frame portions. The extending portions are overlapping and are interactively engaged. There is a tent on the back frame extending portions, a retainer on the seat frame extending portions, and interactive guides and a second tent between the extending portions of each frame.

The interactive engagement may be brought about by first and second counter absorbing elements on the back frame extending portions and a retainer and guide on the seat frame extending portions or the interactive engagement may include interactive interlocking engagable when the sofa bed recliner is in sofa bed position.

The interactive interlocking system may include an interactive guide and a second counter absorbing element between the extending portions or there may be extending portions and a guide on the seat frame extending portions.

The interactive guide may be a groove and the retainer may be a declivity. The seat frame support may have a front portion and a rear portion tapered down from front to rear and the seat frame extending portion may have a bearing surface such as a camber. One end of the back frame support may be an angulated portion to hold the back frame tilted rearward when back frame rests on the floor when the sofa bed recliner is in recliner position.

The frame portions may have slats.

The sofa bed recliner may include a removable arm rest engagable with the back frame and seat frame on their slats. The arm rests may have counter absorbing elements.

Although such novel feature or features believed to be characteristic of the invention are pointed out in the claims, the invention and the manner in which it may be carried out may be further understood by reference to the description following and the accompanying drawings.

In still other embodiments of the present invention, the present invention has guide means and arm frames or side arms. The guide means include preferably two slots in each of the arm frames and preferably two pins connected to the back frame's upper and lower portions, respectively, which extend therefrom into the two slots. The upper slot has a low corner portion that is enlarged to securely engage the upper or first pin in place when the recliner is in its fully extended reclined position.

A counter absorbing element is fixedly mounted onto the sides of the seat frame and one end of each counter absorbing element abuts the bottom portion of the sides of the back frame. The counter absorbing element is contoured at the abutting end when making contact with the bottom portion of a side of the back frame. By fixedly fastening the counter absorbing elements along the axis of the side of the seat frame preferably by either nailing or screwing it therein stress is relieved for the slots of the guide means. Other features will become apparent from the drawings and the foregoing description in which:

BRIEF DESCRIPTION OF THE DRAWING

Referring now to the figures in greater detail, where like reference number denote like parts in the various figures.

DETAILED DESCRIPTION

The description of the figures includes description of one side of the sofa bed recliner 1, it being understood that the parts are symmetrically distributed or mirror imaged throughout the sofa bed recliner 1.

The sofa bed recliner 1, as shown in the figures, is primarily concerned with use with a futon 5.

Figure 1:
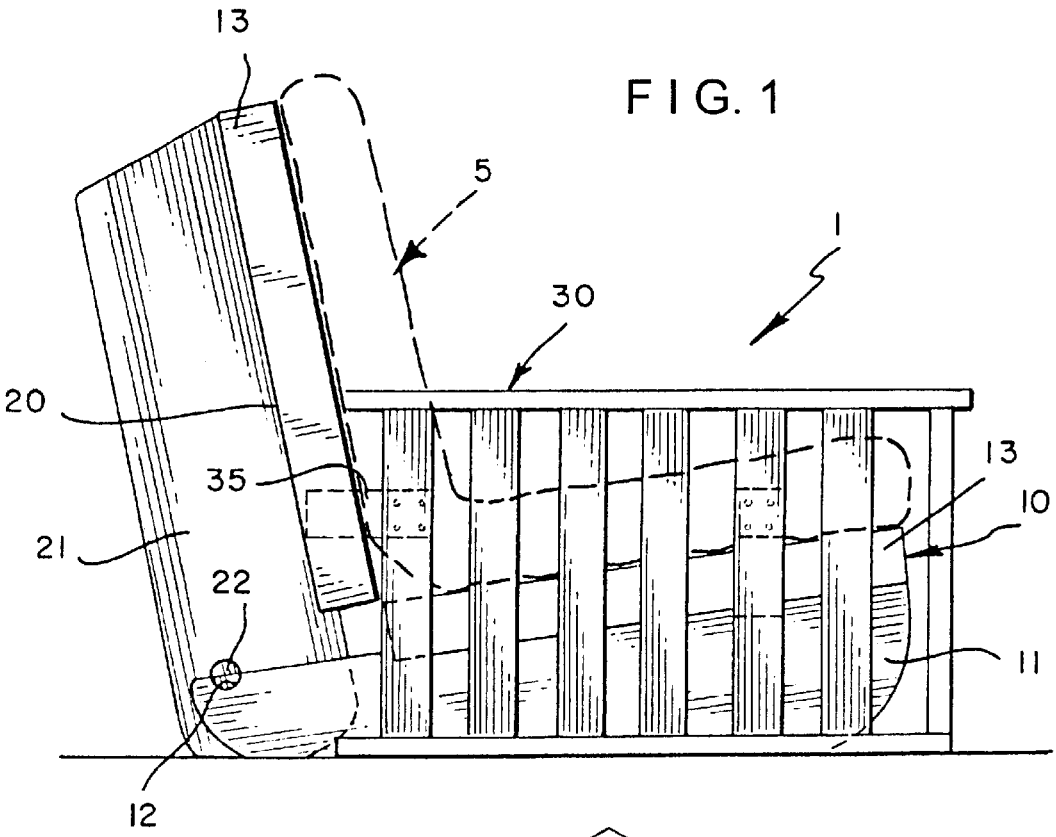
FIG. 1 is a left side elevation or the sofa bed recliner in recliner position, with a futon and with an arm rest.

The sofa bed recliner 1 is shown in FIG. 1 in recliner position. There is a seat frame assembly 10, a back frame assembly 20 and an arm rest 30. The seat frame assembly 10 includes a support beam 11 upon which it is mounted. There are end rails 13 on the seat frame assembly 10. The seat frame assembly 10 includes slats 14 as can best be seen in FIG. 8.

Figure 2:
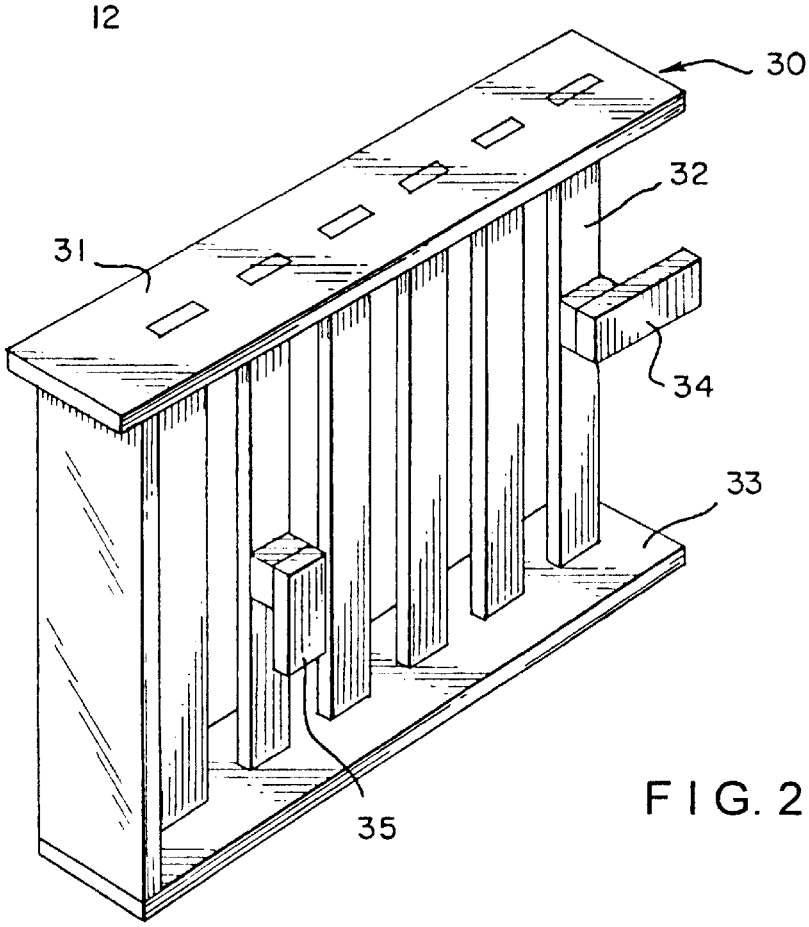
FIG. 2 is an isometric view of the inside of arm rest of FIG. 1.

The arm rest 30 as shown in FIG. 2 has a top portion 31 and a base 33. The top portion 31 and base 33 are joined by slats 32. The rearmost slat 32 includes a horizontal counter absorbing element 34. A vertical counter absorbing element 35 on forward slat 32. The counter absorbing elements 34 and 35 are engagable between slats 14 of the seat frame assembly 10 and back frame assembly 20 respectively to firmly hold the arm rest 30 in position.

Figure 3:
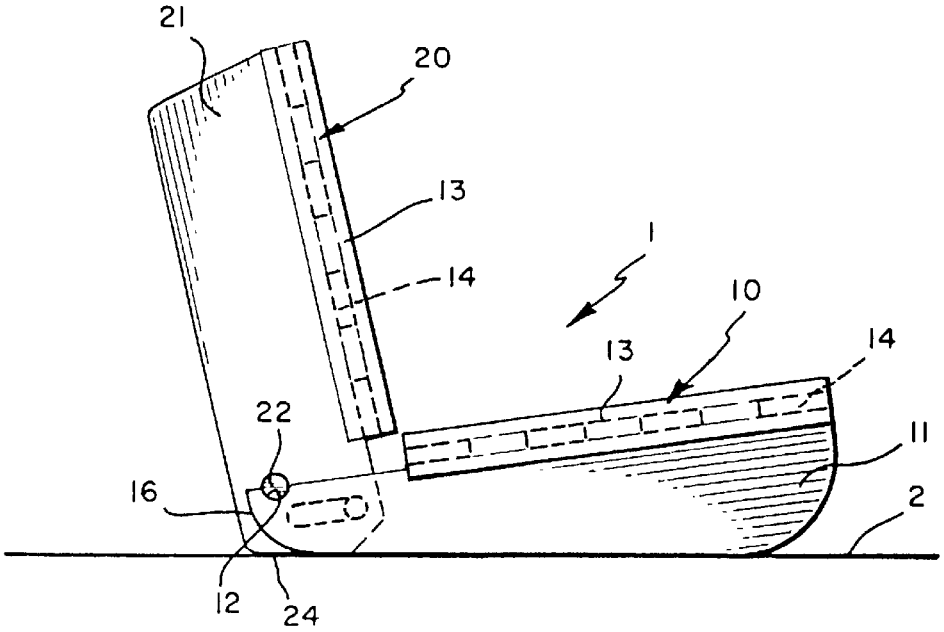
FIG. 3 is a side elevation of the sofa bed recliner of FIG. 1, without an arm rest and futon.

As shown in FIG. 3, sofa bed recliner 1 is in normal recliner position. The seat frame 10 is supported on support beam 11. The back frame assembly 20 is supported on support beam 21. As can best been in FIG. 8, the seat frame, the seat frame assembly 10 and back frame assembly 20 have end rails 13, spaced apart by slats 14. Intermediate support beams 6 rigidify the respective center portions of the seat frame assembly 10 and back frame assembly 20.

The support beam 21 includes a pin 22. As can best be seen in FIG. 9, the support beam 11 includes a groove 15. A pin 23 on the support beam 21 is engaged in the groove 15. The pin 22 on the support beam 21 is engaged in a declivity 12 in the support beam 11.

OPERATION

In use, the sofa bed recliner 1 with the futon 5, functions as complete unit, as shown in FIG. 3 in recliner position.

The support beam 11 elevates the seat frame assembly 10 to a comfortable distance above the floor 2. In use the thickness of the futon 5 adds to the natural height above the floor 2 for convenience and comfort.

The support beam 11 is tapered backwards, effecting a recliner position of the sofa bed recliner 1 with the seat frame assembly 10 on the floor 2 and the back frame assembly 20 erect. The support beam 21, supporting the back frame assembly 20, supporting the back frame assembly 20, has substantially parallel longitudinal edges, as distinguished from the taper of the support beam 11. A pin 22, which may be a dowel in support beam 21, is engagable in a mating declivity 12 in support beam 11.

Figure 9:
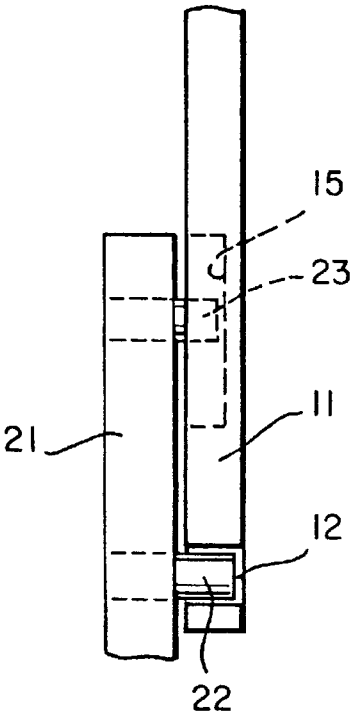
FIG. 9 is a detail front elevation viewed from the left of FIG. 4 showing the seat frame support beam and back frame support beam before disengagement.

As can be seen in FIG. 9, the support beam 21 includes a pin 23, which may be dowel, which is engaged in a groove 15 on the inside of the support beam 11.

As shown in FIG. 3, the inner end 24 of the support beam 21 is angulated and rests on the floor 2, providing the back frame assembly 20 with a rear tilt, commensurate with a recliner position. The back frame assembly 20 is held in position by the combination of the pin 22 and the pin 23, which prevents the back frame assembly 20 from rotating out of control to a horizontal position. the symmetry of the other support beams 11 being outside the support beams 21 maintains the pins 22 and 23 form disengagement.

The uniform width of the support beam 21 is equal to the width of the widest portion of the support beam 11. Thus, as can be seen in FIG. 7, when the sofa bed recliner 1 is in horizonal position, slats 14 of the seat frame assembly 10 and back frame assembly 20 are parallel to the floor 2.

Figure 4:
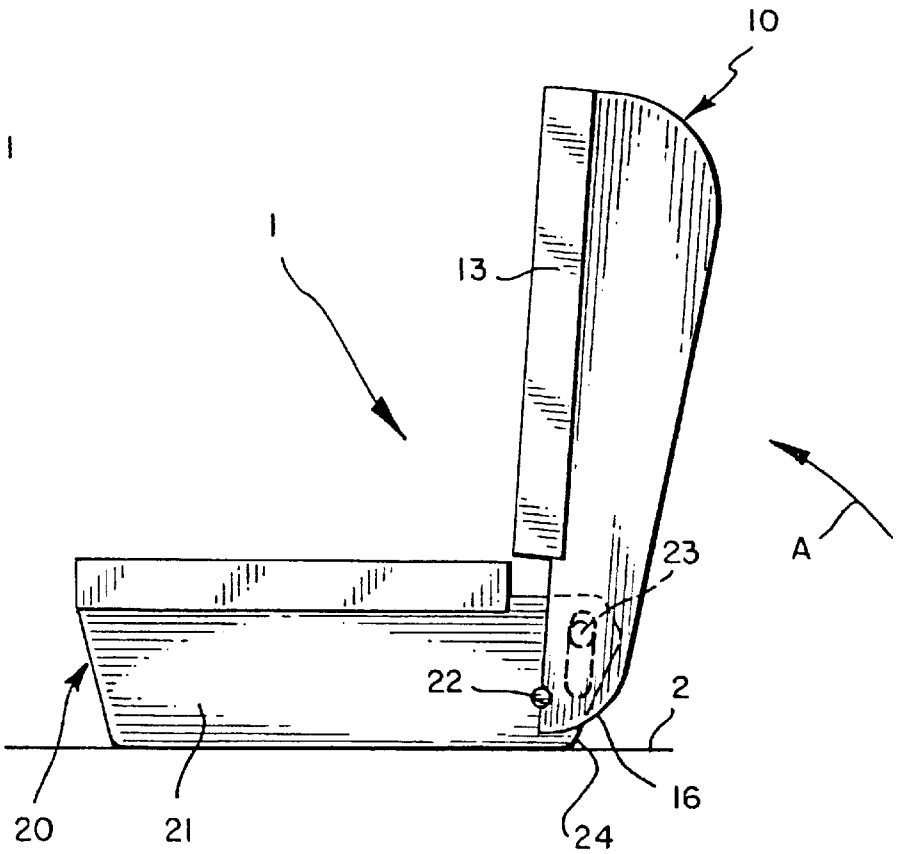
FIG. 4 is a side elevation of the sofa bed recliner of FIG. 3, with the back frame assembly rotated to rest on the floor in the first step of conversion to a sofa bed horizontal position.

The steps in the conversion and reconversion can be seen in FIGS. 4 through 7. In FIG. 4, the sofa bed recliner 1 is rotated in the direction of arrow A, lifting the seat frame assembly 10 and rotating the back frame assembly 20 to rest on the floor 2.

Figure 5:
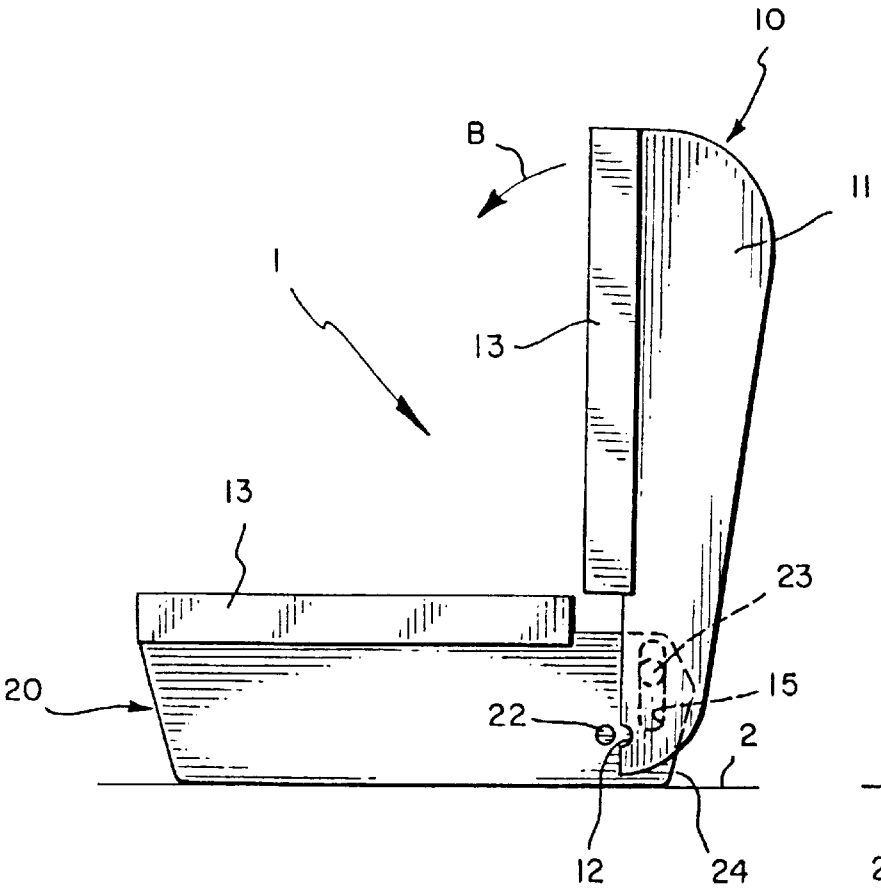
FIG. 5 is a side elevation of FIG. 4 showing the second step, the release of the seat frame assembly.
Figure 6:
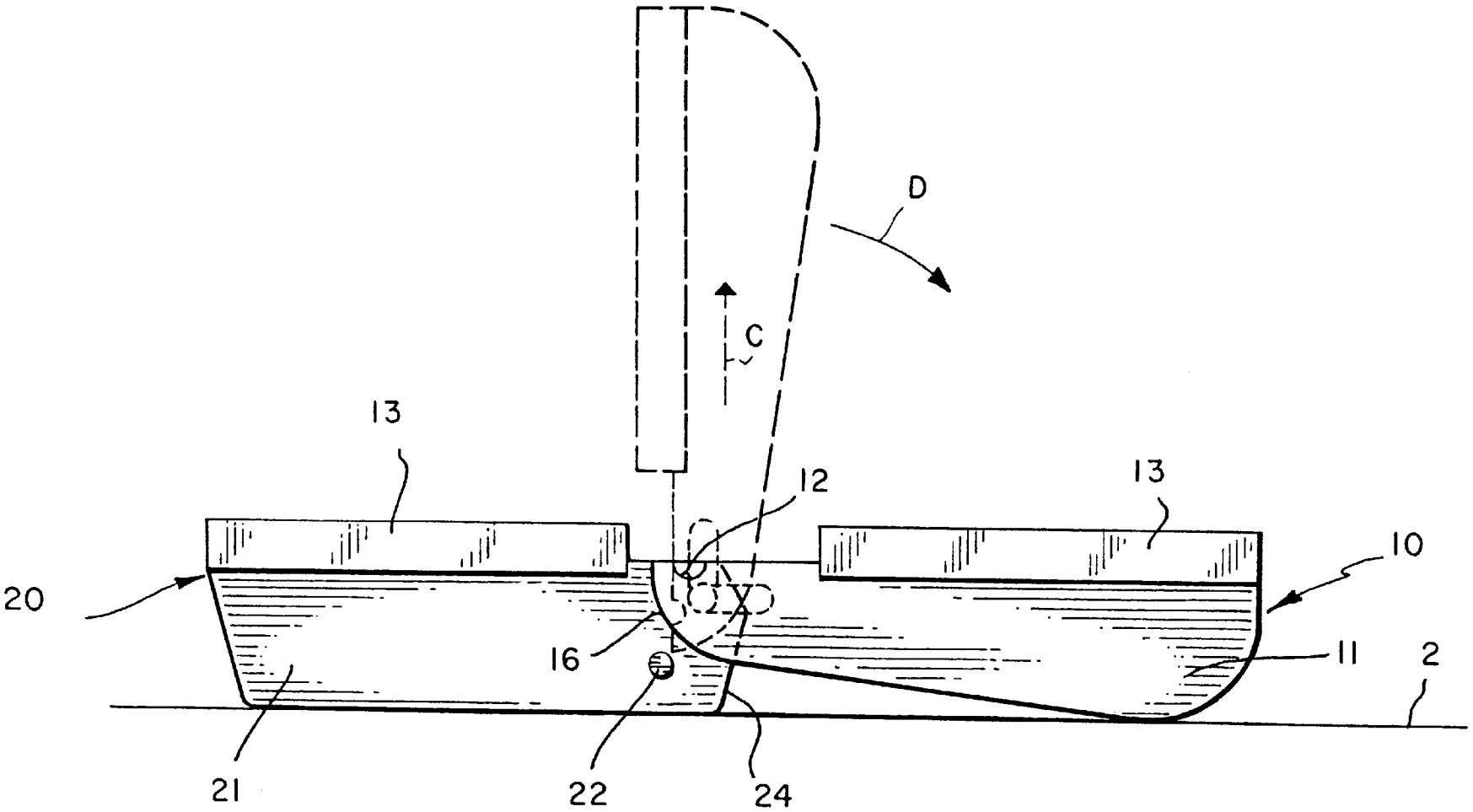
FIG. 6 is a side elevation of FIG. 5 showing the third step, the rotation of the seat frame assembly to horizontal position.

As shown in FIG. 5, a small movement of the seat frame assembly 10 in the direction of arrow B disengages the pin 22 from the declivity 12. The rotation is about the pin 23 as a fulcrum. Once the pin 22 is out of the declivity 12, a small movement, as shown in FIG. 6, in the direction of arrow C, releases the interlocking engagement of sea frame assembly 10 and back frame assembly 20, so that the seat frame assembly may be freely rotated in the direction of arrow D to horizontal position, pivoting on pin 23.

Figure 7:
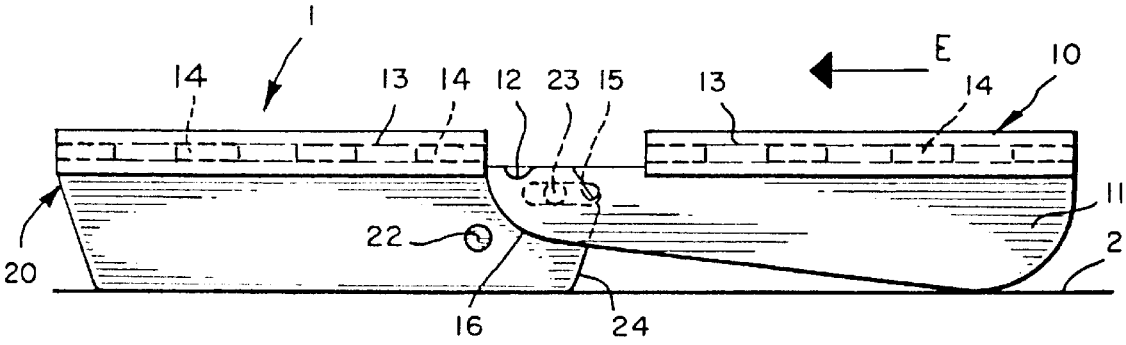
FIG. 7 is a side elevation of FIG. 6 showing the fourth step of interlocking the seat frame assembly and back frame assembly in horizontal position.

As shown in FIG. 7, a movement of the seat frame assembly 10 in the direction of arrow E locks the support beam 11 between the pin 22 and the slats 14 of back frame assembly 20. The support beam 11 cams on the cambered portion 16 of the support beam 11 and causes a locking engagement.

This locking engagement maintains the seat frame assembly 10 and back frame assembly 20 in their respective positions and also serve to prevent jackknifing of the sofa bed recliner 1 when in use in a horizontal position.

Figure 8:
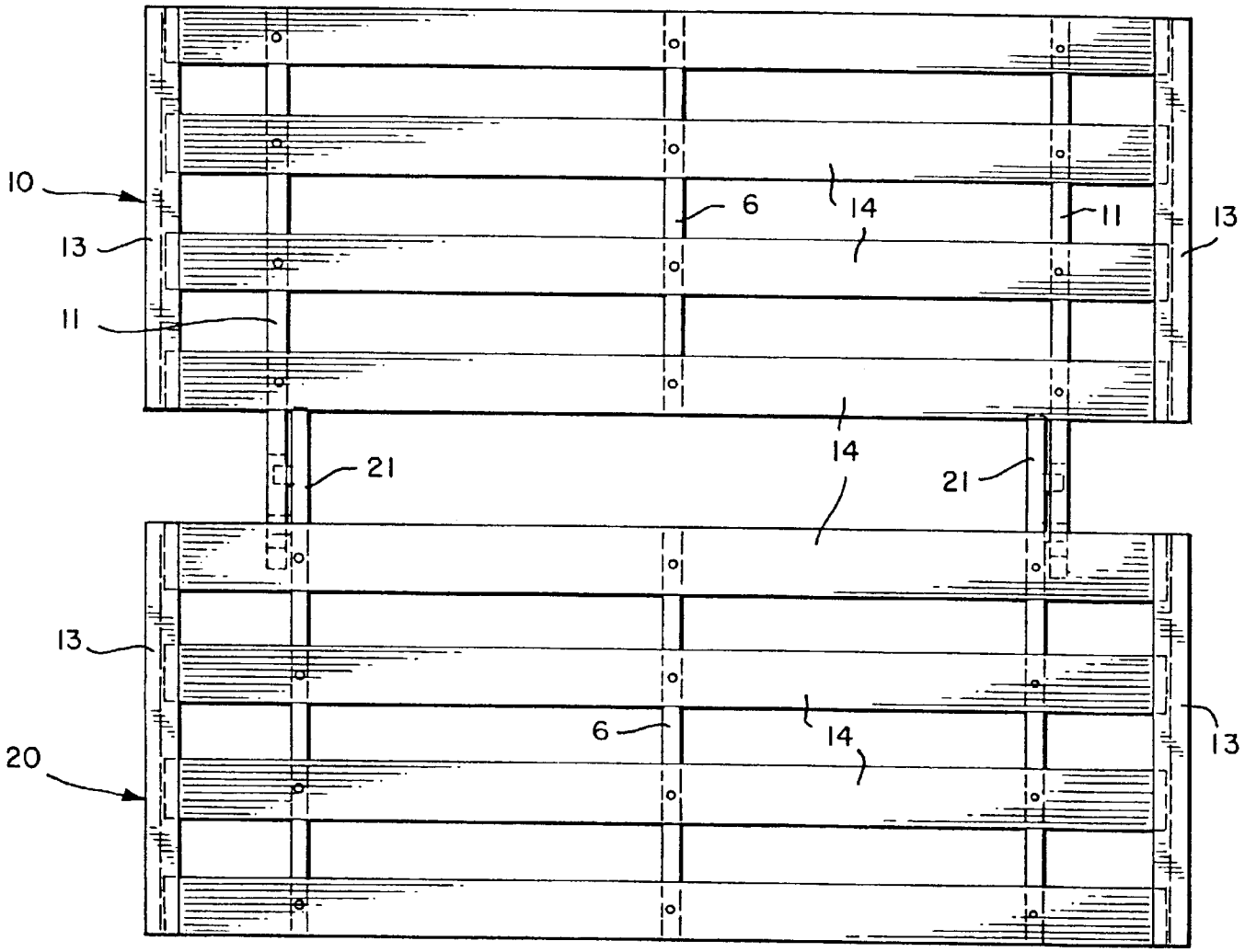
FIG. 8 is a top plan of FIG. 7 with the seat frame assembly and back frame assembly interlocked.
Figure 10:
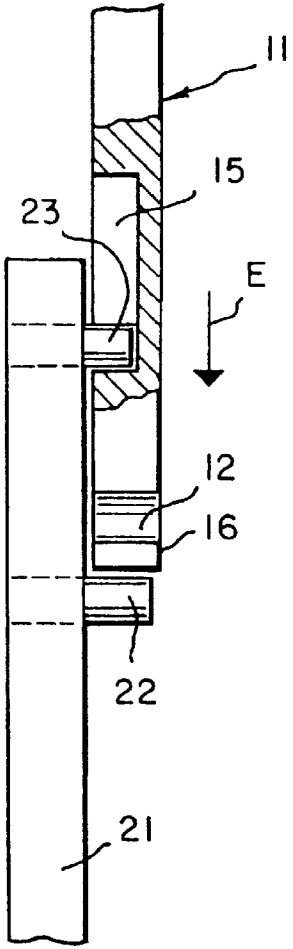
FIG. 10 is a detail, partially sectioned, plan view of FIG. 7 showing the seat frame support beam and back frame support beam disengaged.
Figure 11:
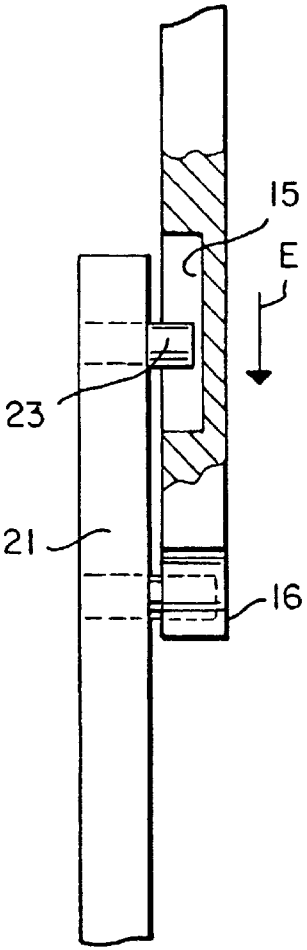
FIG. 11 is a detail, partially sectioned, plan view of FIG. 10 showing the seat frame support beam and back frame support beam interlocked.

As shown in FIGS. 10 and 11, the pin 23 in the groove 15, when moved in the direction of arrow E, cams on the cambered portion 16 of the support beam 11, giving and upward thrust for the locking engagement, as indicated in FIG. 7, as can be seen in FIG. 8.

Support beams 6 span the seat frame assemblies 10 and back frame assemblies 20, to rigidize the slats 14.

They may (not shown) be shaped to conform to the their respective support beam 11 and 21, so that they can rest on the floor 2.

The reconversion from the sofa bed horizontal position is a reversal of the conversion steps. The seat frame assembly 10, as shown in FIG. 7, is withdrawn in the direction opposite that of arrow E. The seat frame assembly 10 then is lifted in the direction opposite that of arrow D. The cambered portion 16 of the support beam 11 rotates about pin 23 and cams against pin 22 until the seat frame assembly 10 is vertical and the pin 22 is beyond the top of the support beam 11.

At that point, the seat frame assembly 10 assembly drops downward in a direction opposite arrow C, guided by the groove 15.

At that point, the declivity 12 is engagable with the pin 27, as shown in FIG. 5, moving in the direction opposite arrow B. As shown in FIG. 4. The sofa bed recliner 1, is then rotatable in the direction opposite arrow A and is reverted to its recliner position, as shown in FIG. 3.

Once back in this position, the optional arm rest 30 may be. engaged with the horizontal counter absorbing element 34, engaged between slats 14 of the back frame assembly 20 and the vertical counter absorbing element 35 engaged between two slats 14 of the seat frame assembly 10.

Figure 12:
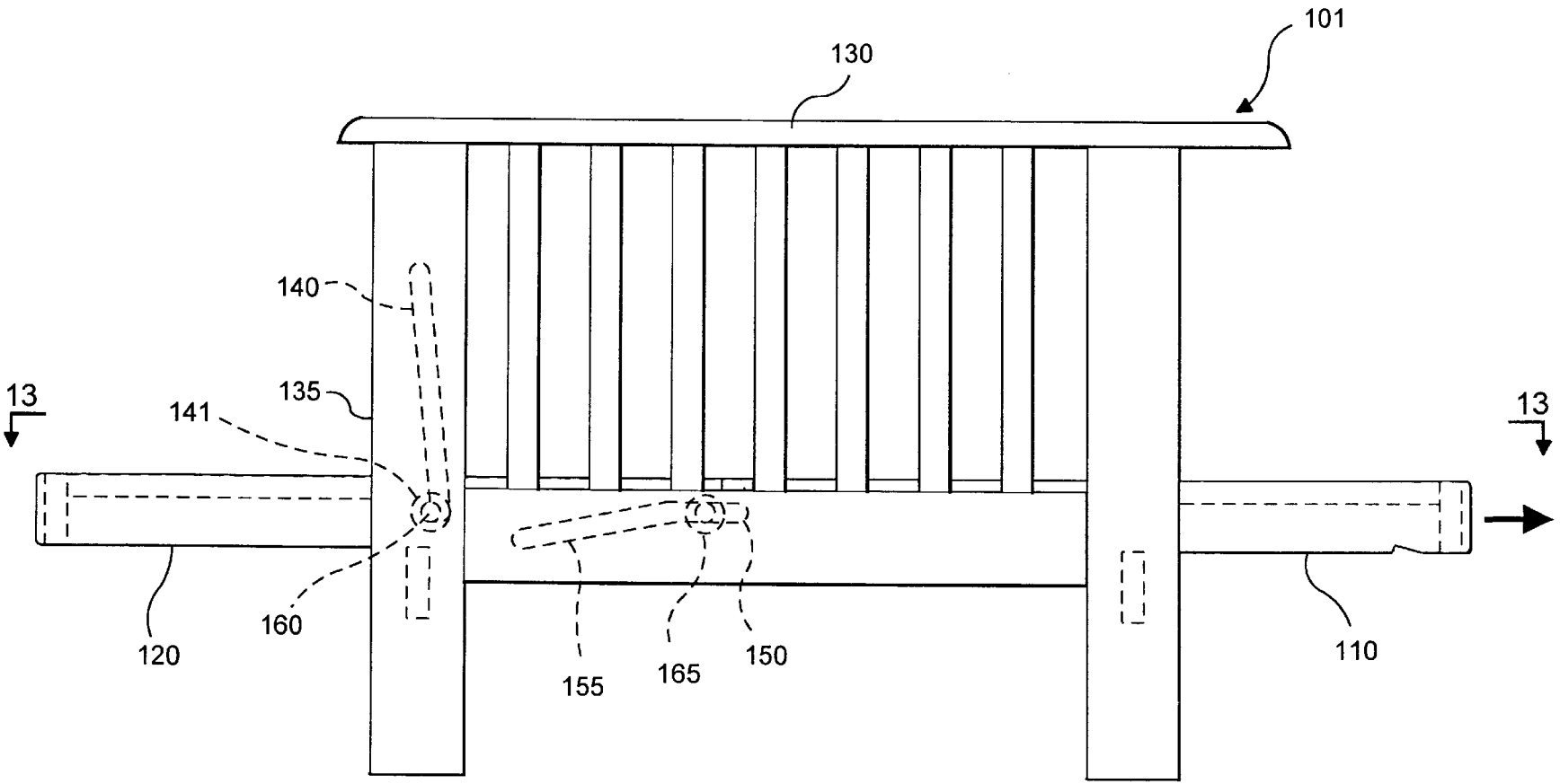
FIG. 12 is a side elevated view of the futon in horizontal position.
Figure 13:
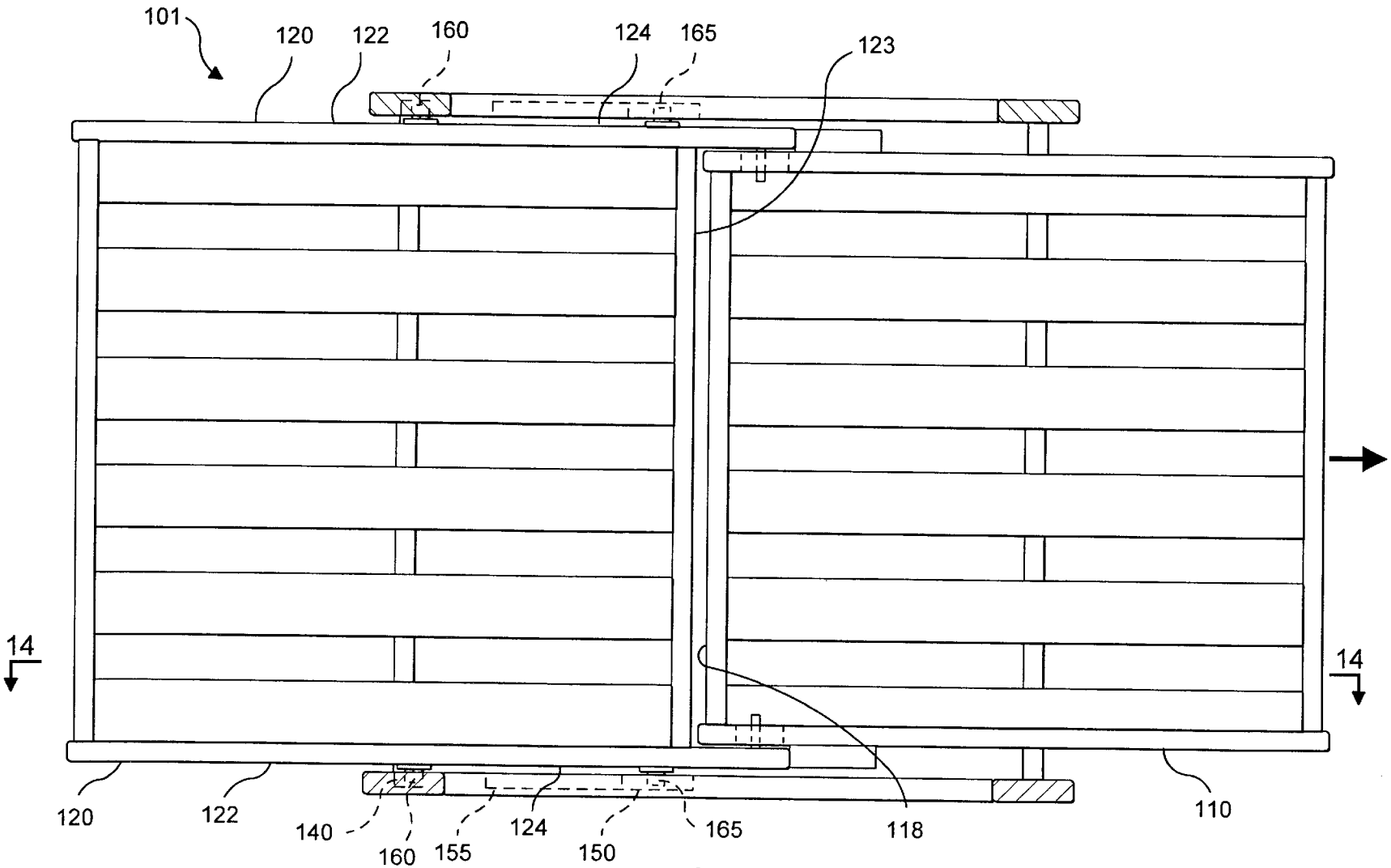
FIG. 13 is a top view in horizontal position.

Referring now to the embodiment in FIGS. 12–28 of the drawings, as can be seen from the side elevational view of FIG. 12, the futon recliner 101 is shown in its fully reclined position. FIG. 12 shows in side view, that one of the arm frames 130 is provided with two slots or grooves, one in a vertical section of the arm frame 130 for substantially vertically oriented slot 140 and a horizontally oriented slot 150 located in a horizontal section 132 of the arm frame 130. The horizontally oriented slot 150 has a portion 155 that tapers downward in the direction of the vertical portion 135 of the arm frame 130. A first pin 160 and a second pin 165 are extended into the vertical slot 140 and horizontal slot 150, respectively, as can be seen in FIG. 12 and in the top view of FIG. 13. These pins 160, 165, extend from upper (122) and lower (124) portions of the back frame 120.

Figure 14:
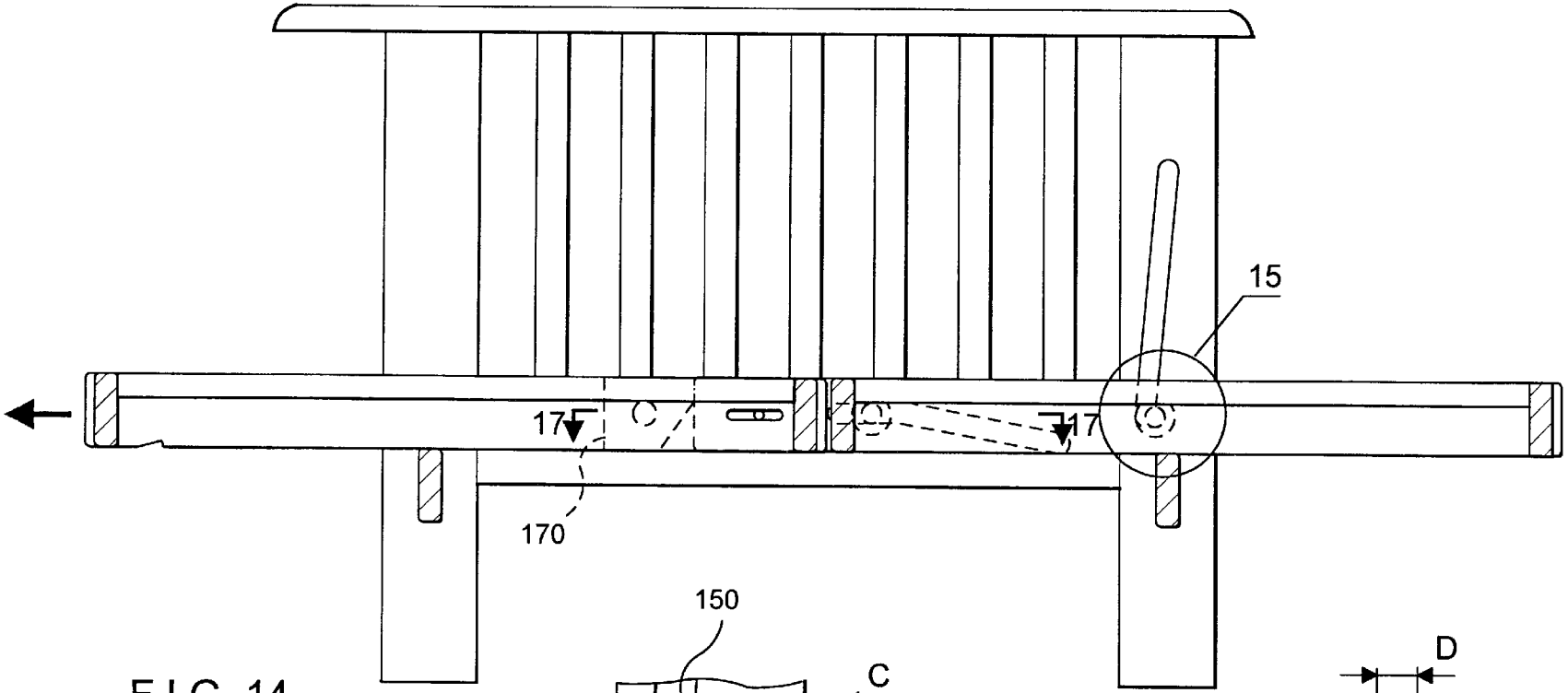
FIG. 14 is a section of the futon in horizontal position.
Figure 15:
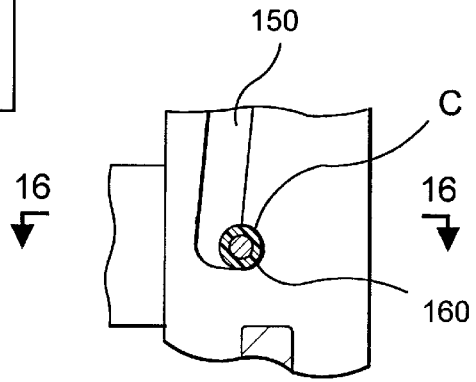
FIG. 15 is an enlarged view of the groove and first pin.
Figure 16:
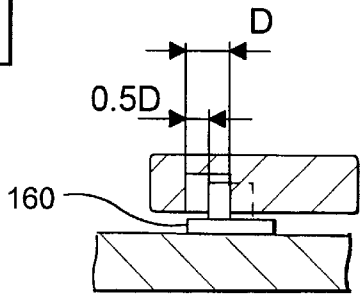
FIG. 16 is a section showing first pin in the extreme position.
Figure 19:
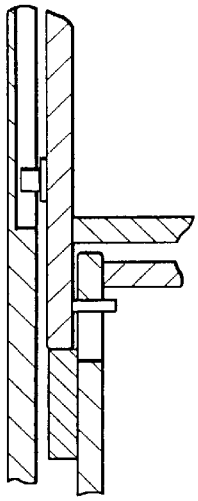
FIG. 19 is a partial section in which the second pin is in the extreme right position.
Figure 17:
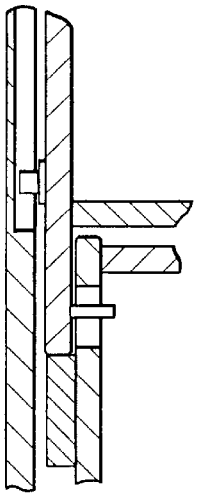
FIG. 17 is a partial section showing positions of the first and second pins when the futon is flat.
Figure 18:
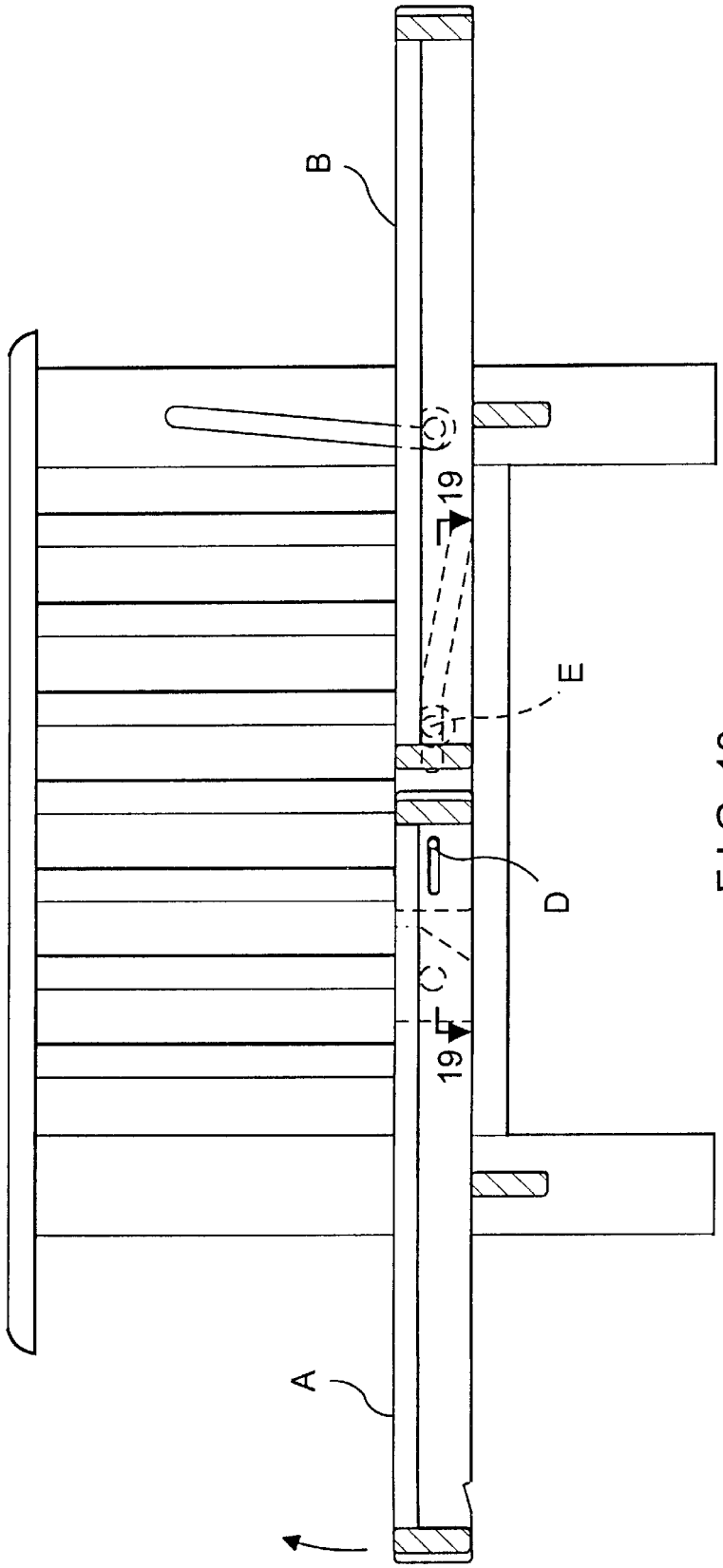
FIG. 18 is a side elevated view showing the back frame being pulled left.

FIGS. 14, 15, and 16 show the recliner (101). In FIG. 14 the recliner is again in its horizontal position. The counter absorbing elements 170 can be seen in FIG. 14. FIG. 15 shows an enlarged view of the pin in the slot. FIG. 16 again shows the pin in an extreme position in the slot. First and second pins 160, 165, can be seen in relation to one another in position in FIG. 17. Similar views of the pin are shown in FIGS. 18 and 19.

Figure 20:
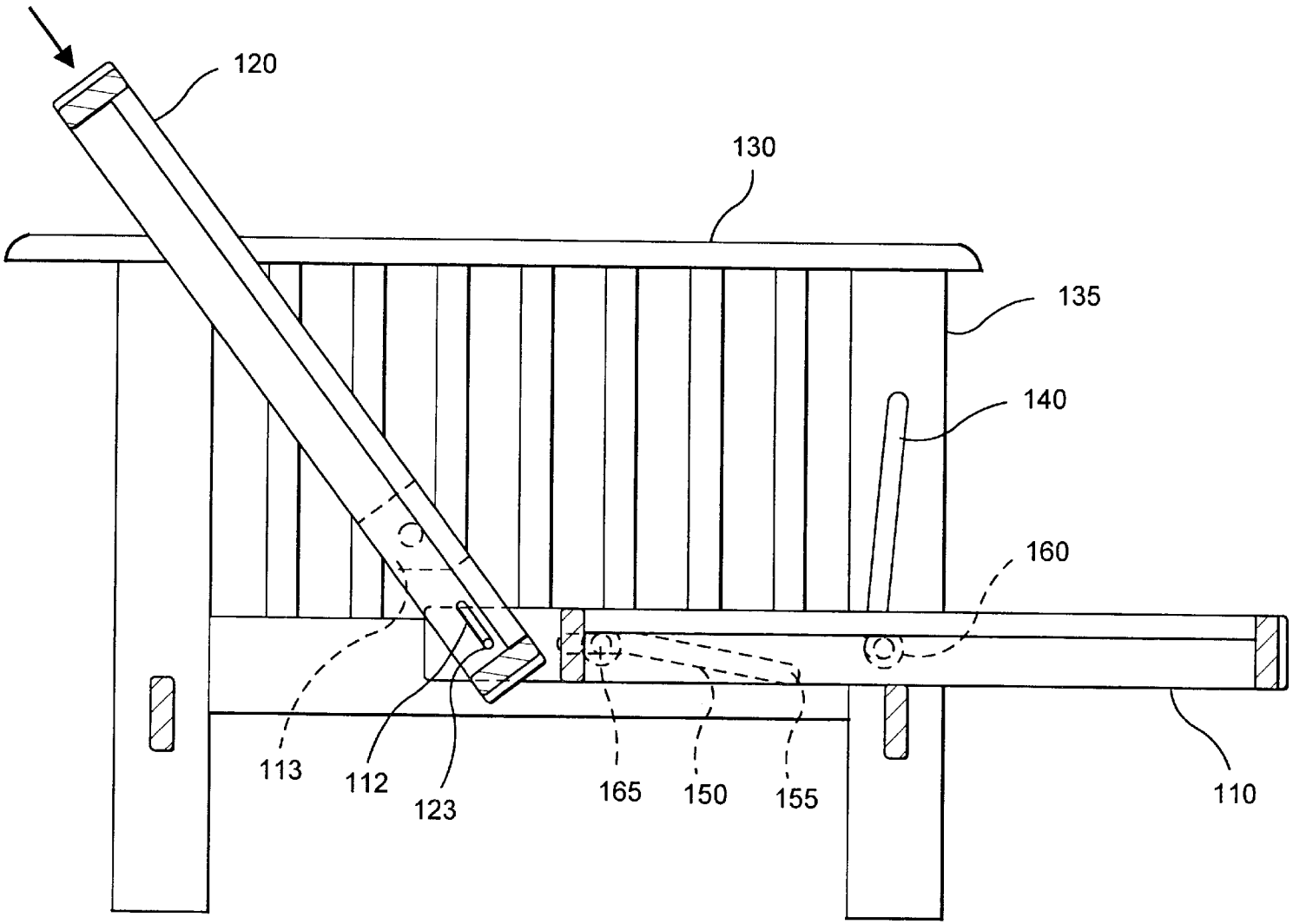
FIG. 20 is a side elevated view with the back frame being lifted and turned around the second pin.
Figure 23:
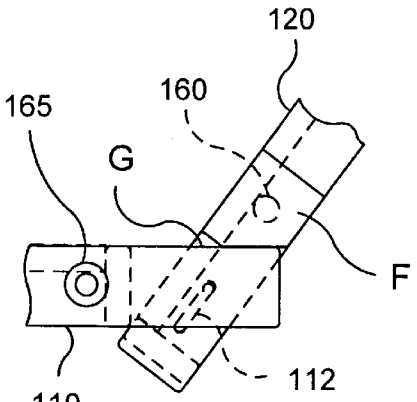
FIG. 23 also shows a section showing detail F sitting on surface G.
Figure 22:
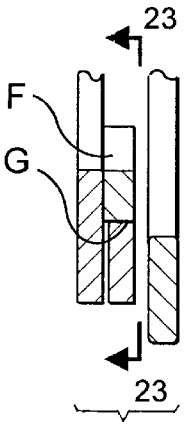
FIG. 22 is a section showing detail F sitting on surface G.
Figure 21:
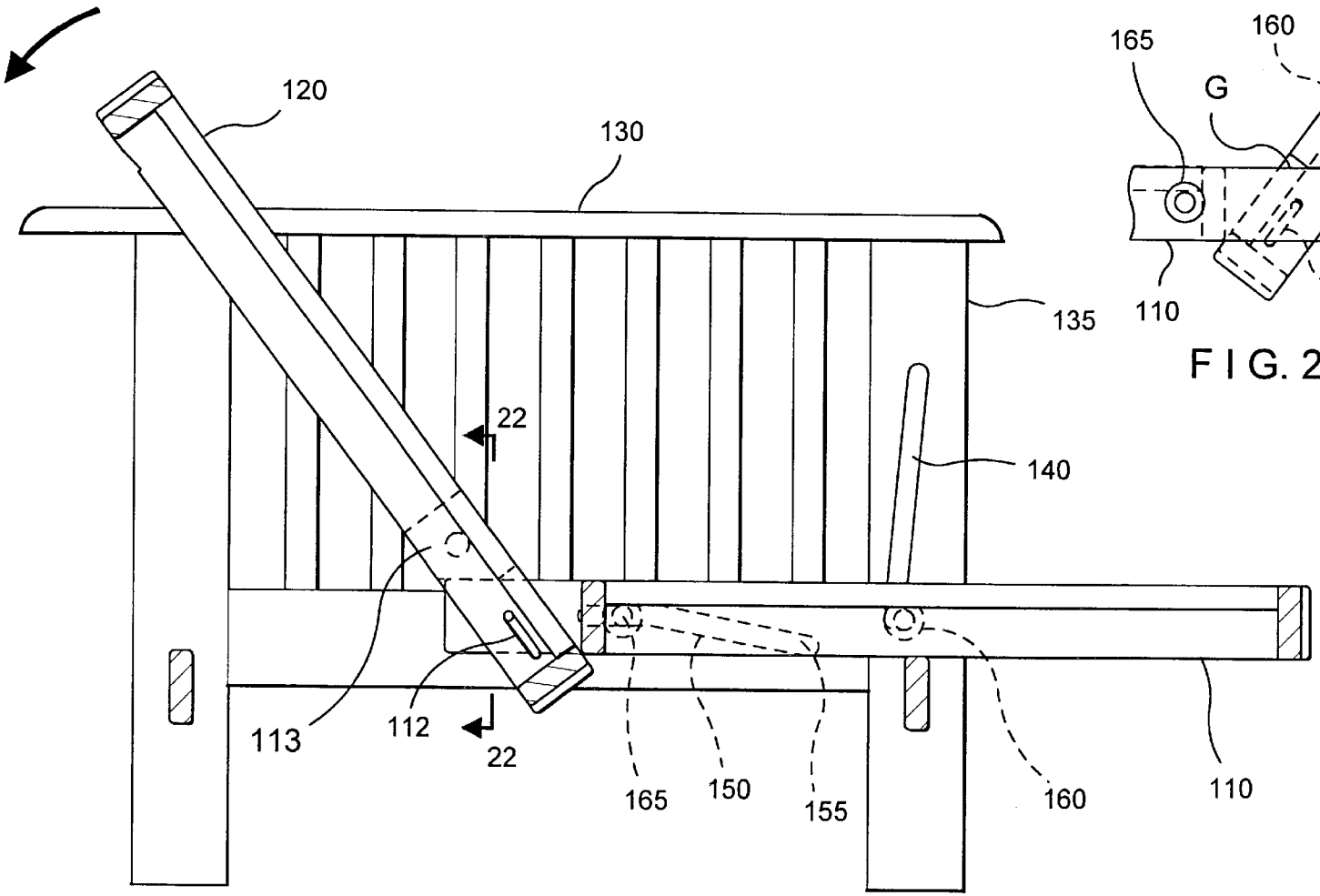
FIG. 21 is the same with the back frame pushed all the way down.
Figure 25:
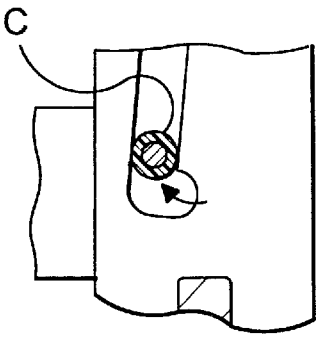
FIG. 25 is an enlarged sectioned view of the groove and the first pin when the seat frame is beginning to be lifted.
Figure 24:
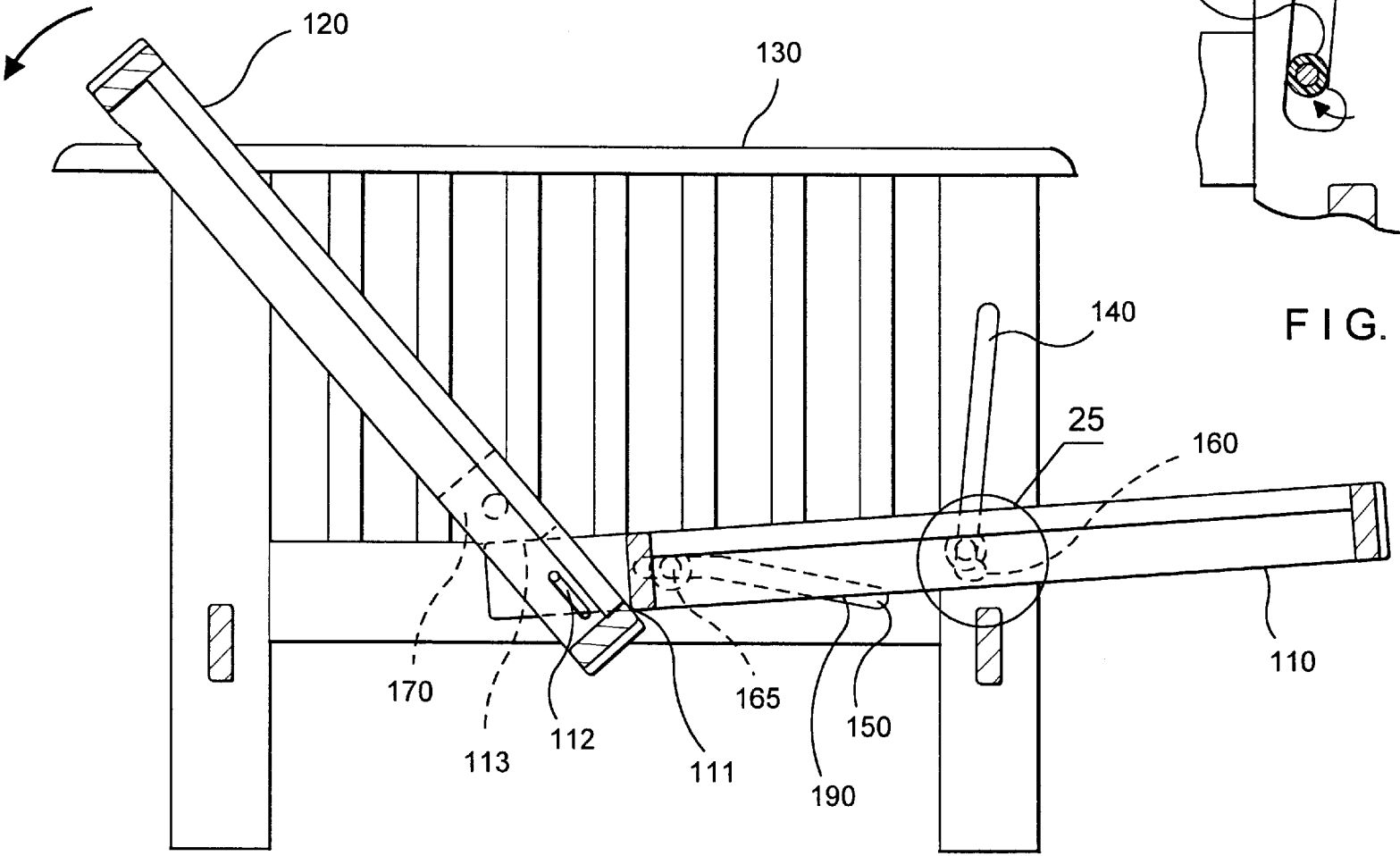
FIG. 24 is a side elevated view showing the first stage of putting the futon in a back-rest position.
Figure 26:
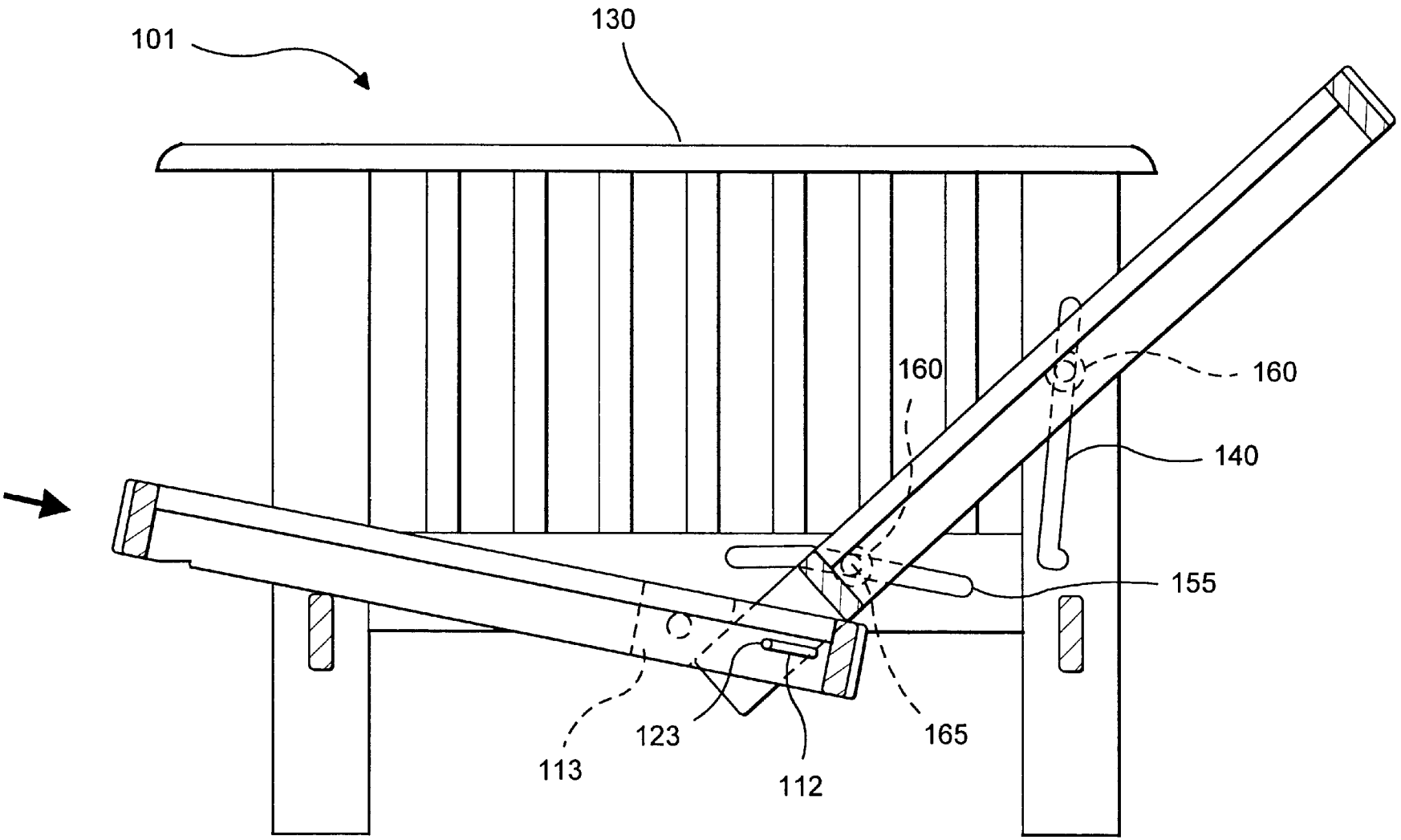
FIG. 26 is a side elevated view of the intermediate position.
Figure 27:
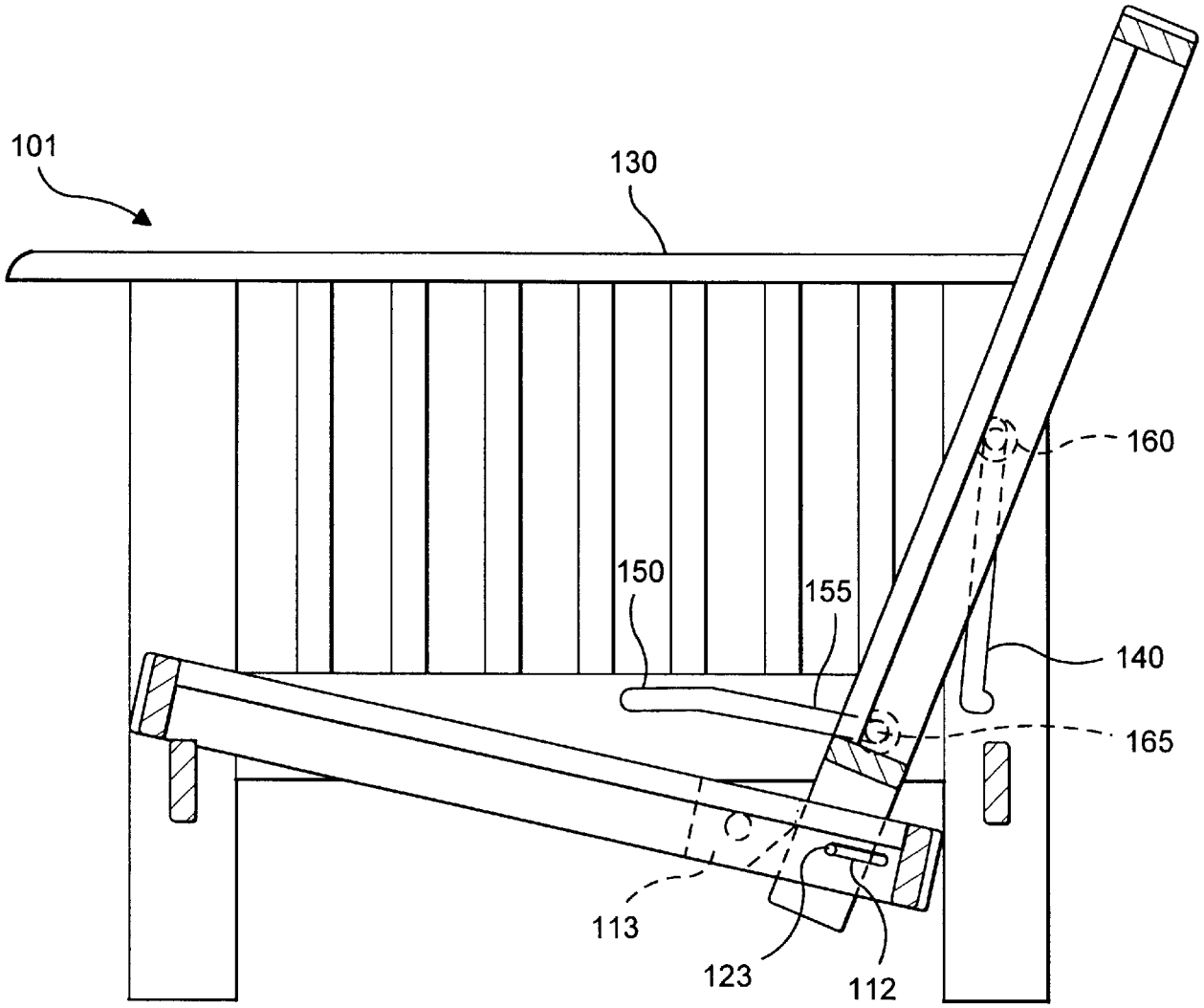
FIG. 27 is a side elevated view in a back rest position.
Figure 28:
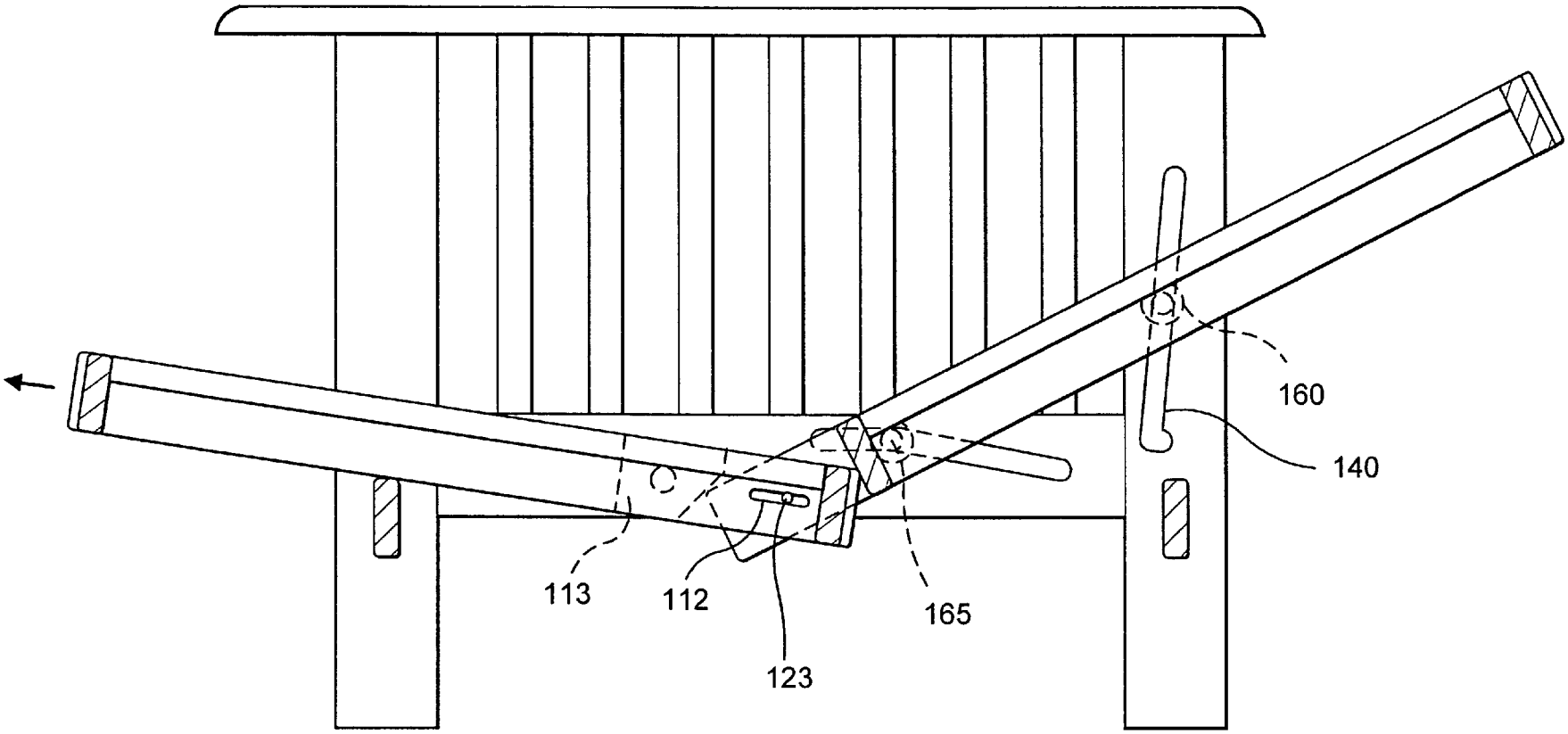
FIG. 28 is a side elevated view with the back frame being pulled left, which causes the futon to move back to a flat position.
Figure 29:
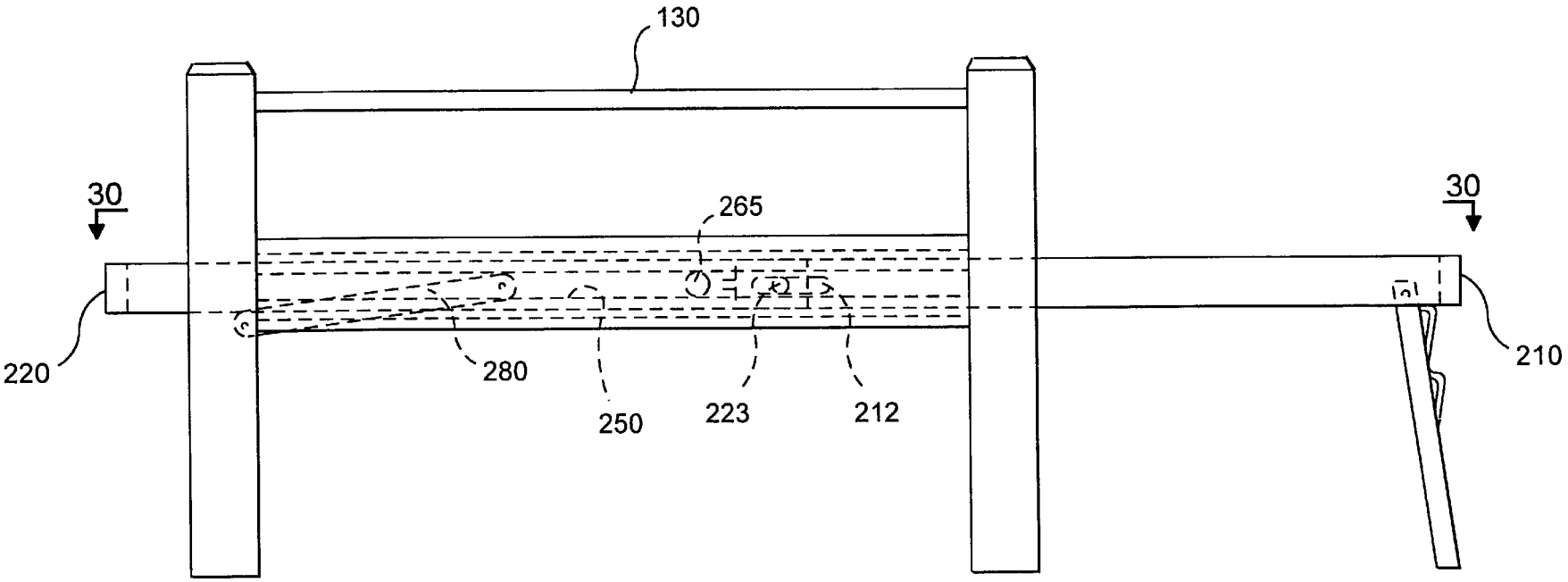
FIG. 29 is a side elevated view of the futon in horizontal position.
Figure 30:
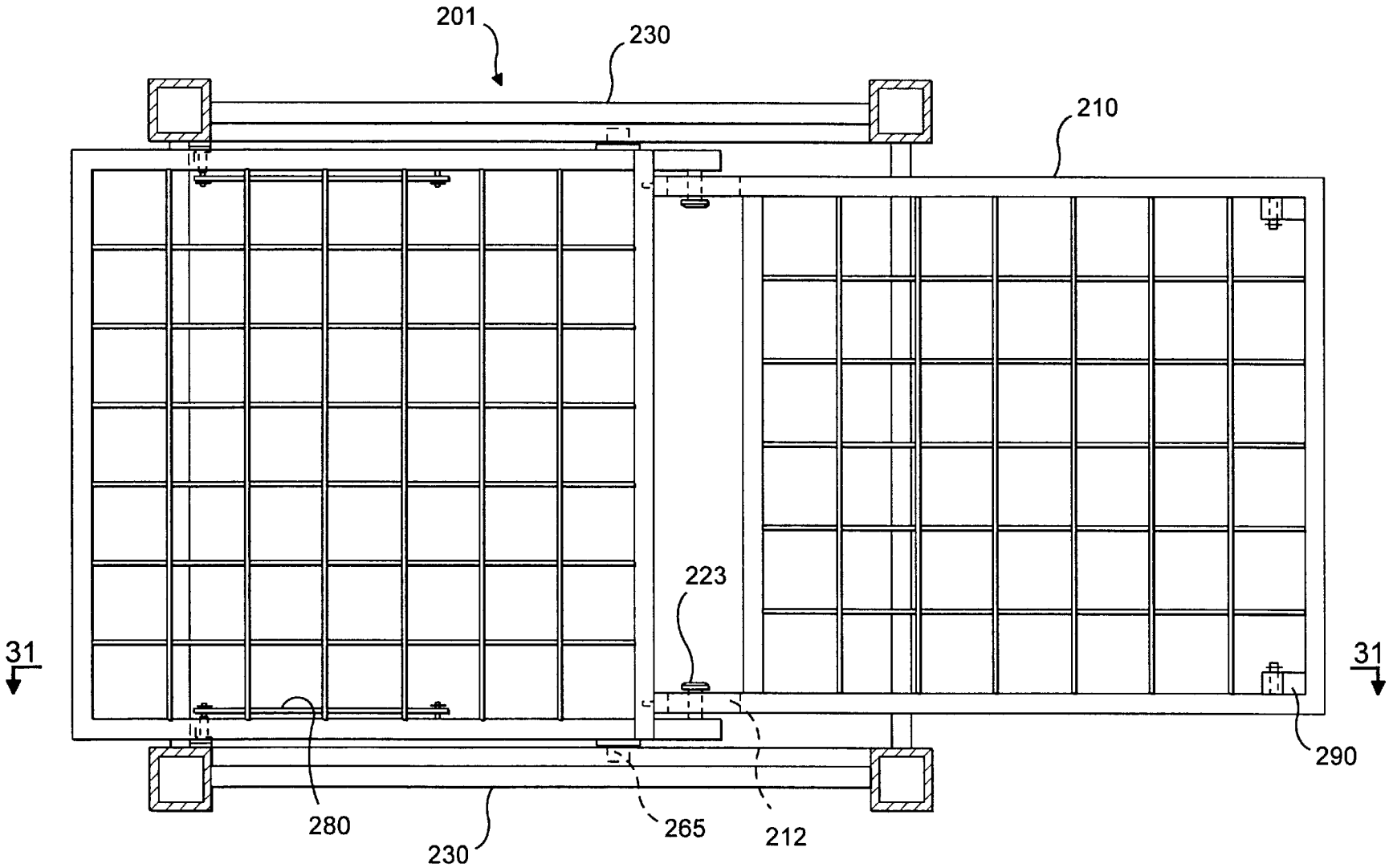
FIG. 30 is a top view in horizontal position.

FIG. 20 shows the recliner with the back frame partially elevated. FIGS. 21–23 show of the recliner and its components where its moving in the direction of the arrow. Similarly, in FIGS. 24 and 25 one of the slots and its associated pin is shown when the back frame 120 begins moving upward. In FIG. 24, the counter absorbing element 170 has a surface 113 which when the back frame 120 moves in the direction of arrow A absorbs and transmits pressure along the length of the seat frame 110 from the pressure received at point 111 where the back frame 120 meets the seat frame 110, and thus, minimal or no pressure is exerted on the pin and the slot at point 112. Further the slot can be made larger by preferably 1/32 of an inch at the point the pin is at in FIG. 24 to reduce or eliminate pressure at that point 2. FIG. 26 also shows the counter absorbing elements with respect to the bottom portion of the back frame in relieving stress on the slot as the pin moves within the slot. FIG. 27 shows the recliner in a back rest position and then the movement of the pins 160, 165, within the slots 140, 150 and the counter absorbing elements 170 position respective to the bottom portion 123 of the back frame 120. FIG. 28 shows the recliner 101 as it is being pulled fully backward. It is preferable that the recliner is made of wood, although the invention is not limited to any particular material.

It is also understood that the invention could be made of two dowels (not shown) protruding from the bottom portion of the back frame 120 insert with two holes (not shown) on the opposing portion 118 of the seat frame 110 so as to lock the recliner 101 in to place when in the fully extended horizontal position to jackknifing of the recliner 101.

Figure 31:
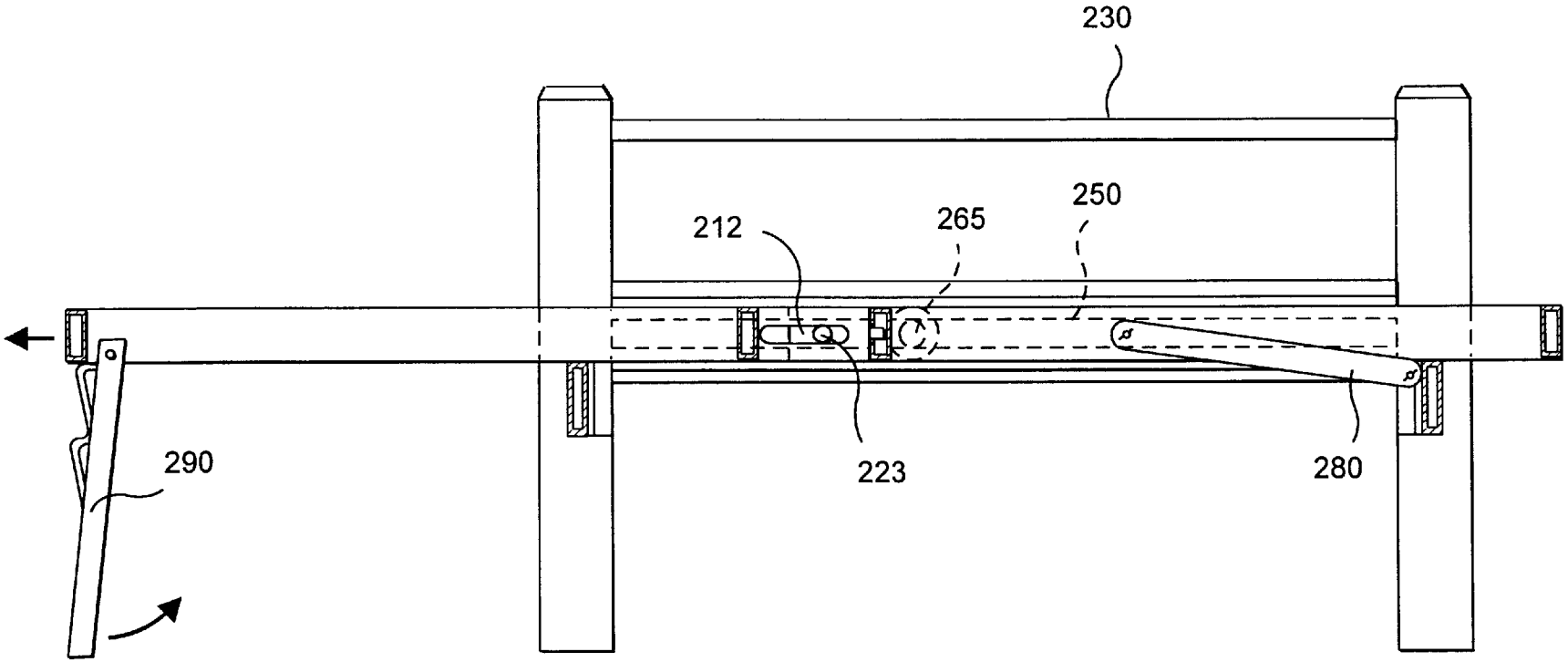
FIG. 31 is a section of the futon in horizontal position, the back frame and the seat frame interlocked by means of the pins.
Figure 32:
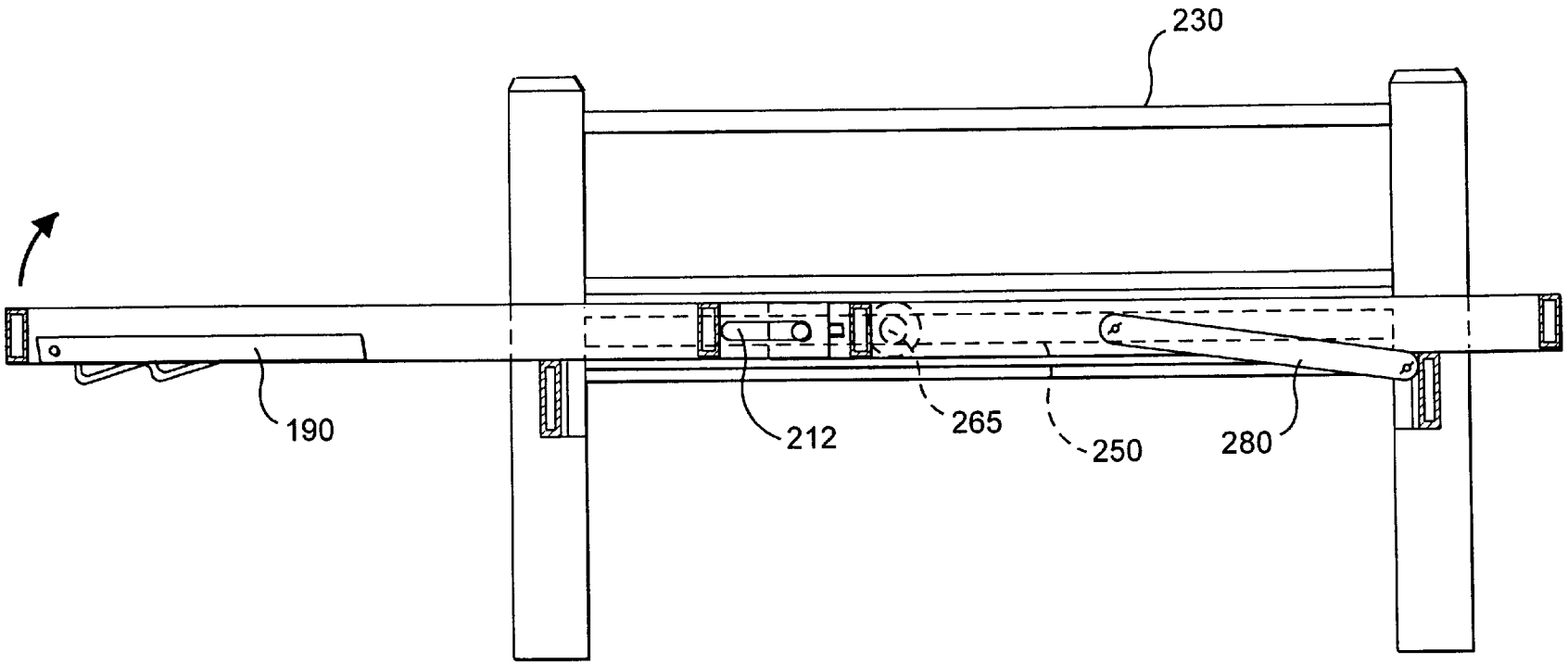
FIG. 32 is the same, with the back frame and seat frame disengaged.
Figure 33:
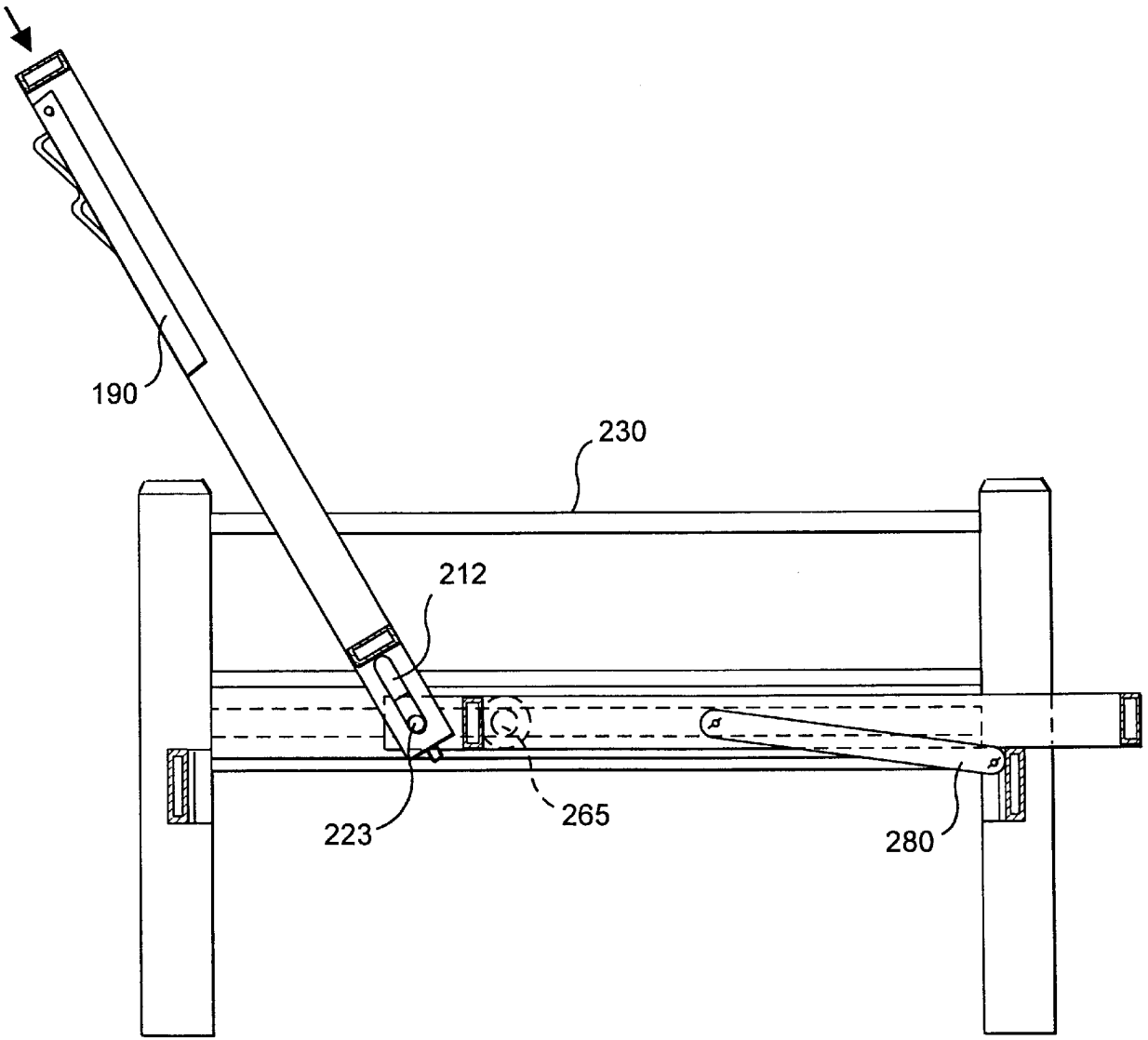
FIG. 33 is a section, with the back frame being lifted, and the second in the extreme lower position.

Referring now to the embodiment shown in FIGS. 29–36, FIG. 29 shows a side elevational view in the fully reclined position of the recliner as seen from the top view. The recliner again 201 is provided with guide means. In this case, the guide means have pins 260, 265 which extend from the side portions of the back frame 220 into the slots 240, 250 on the opposing surface of the arm frames 230. As shown in FIG. 31, the elements could be interlocked by means of the first and second pins 260, 265. FIG. 32 shows this recliner 201 in its disengaged state. FIG. 33 shows the back frame being lifted with the second pin 265 in the extreme lower position.

Figure 34:
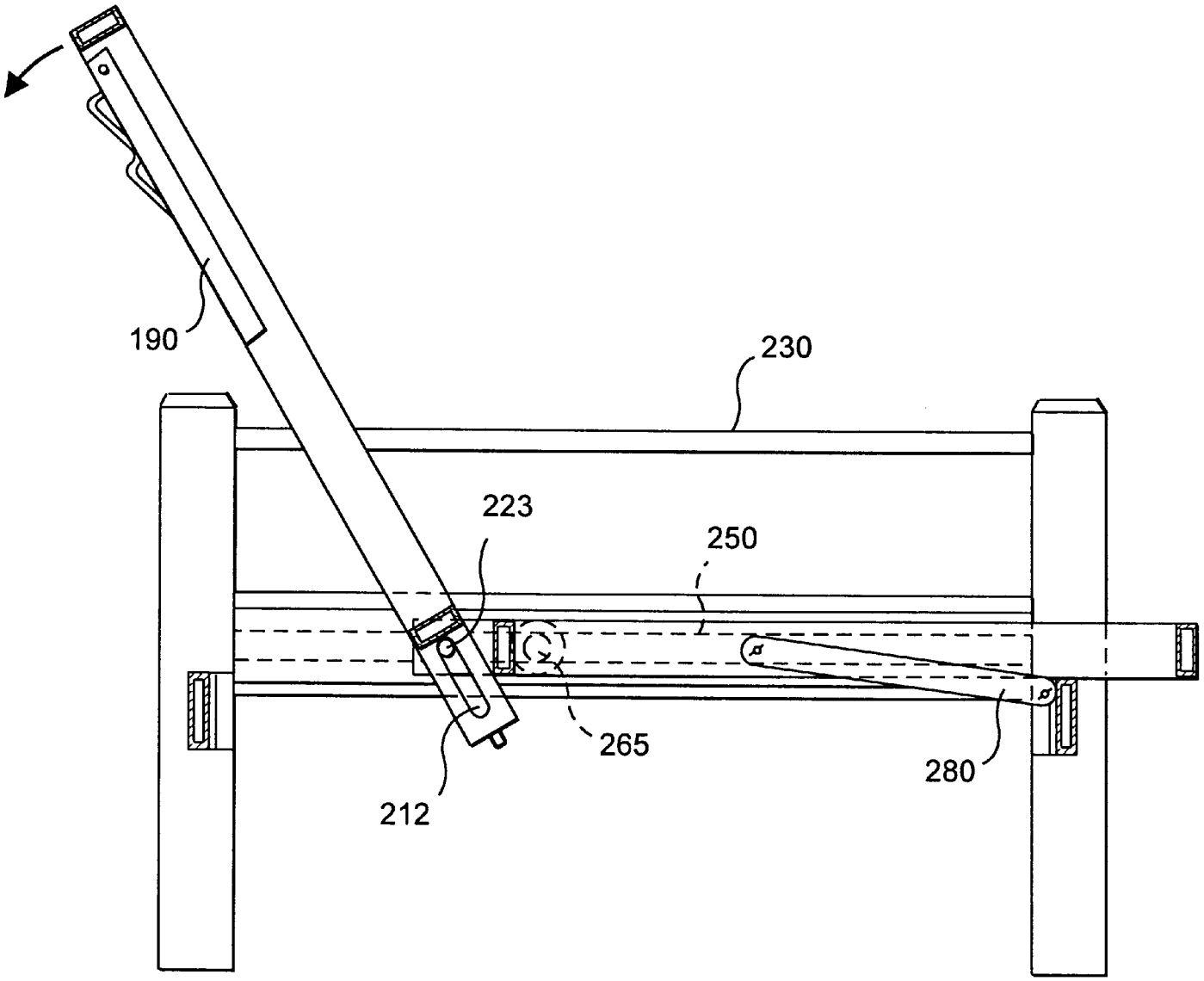
FIG. 34 is the same as FIG. 33 with the back frame pushed down, and the second pin in the extreme upper position.
Figure 35:
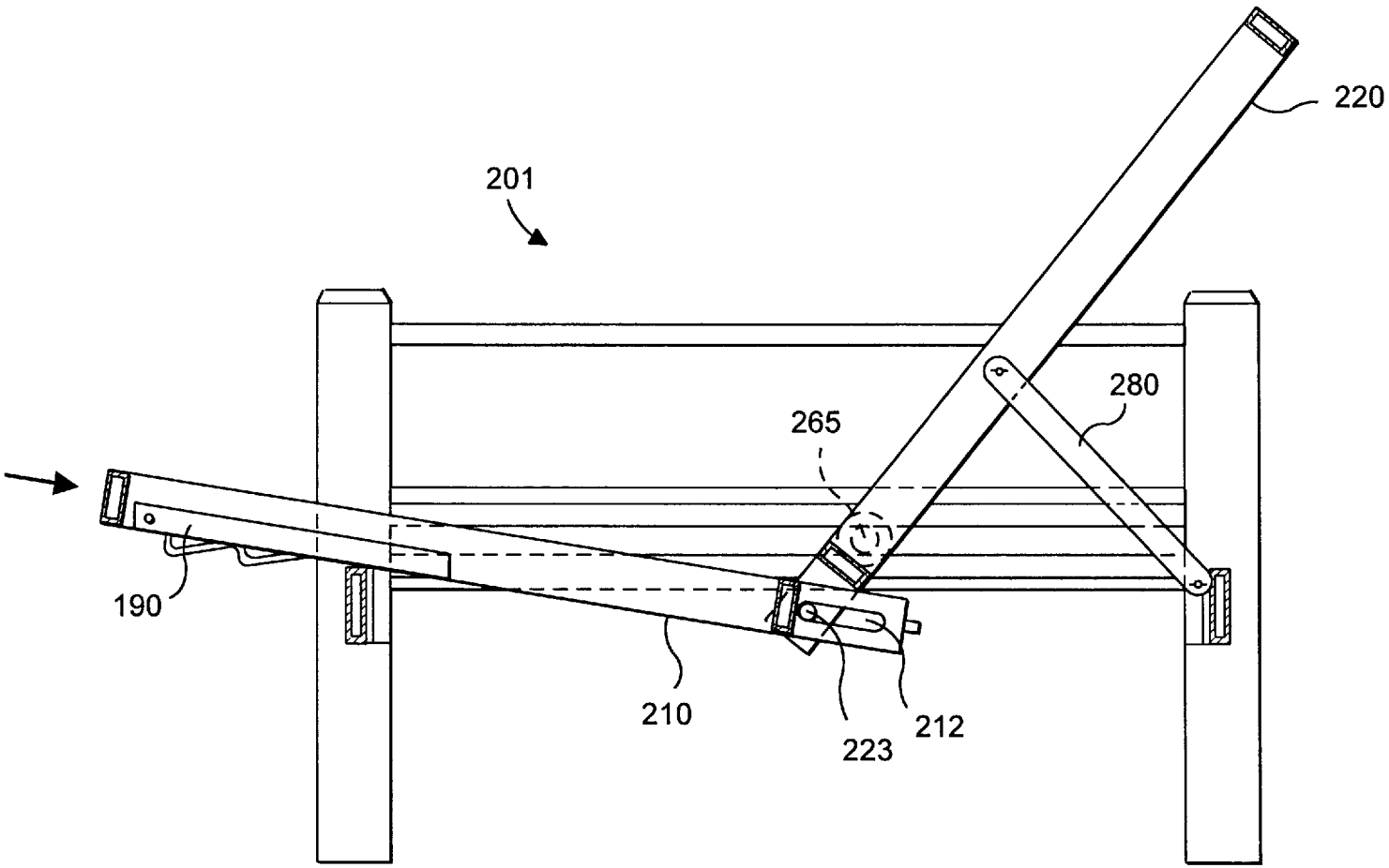
FIG. 35 is a sectional view showing the back frame being pivoted around the second pin, and the seat frame being pushed up toward the back-rest position.
Figure 36:
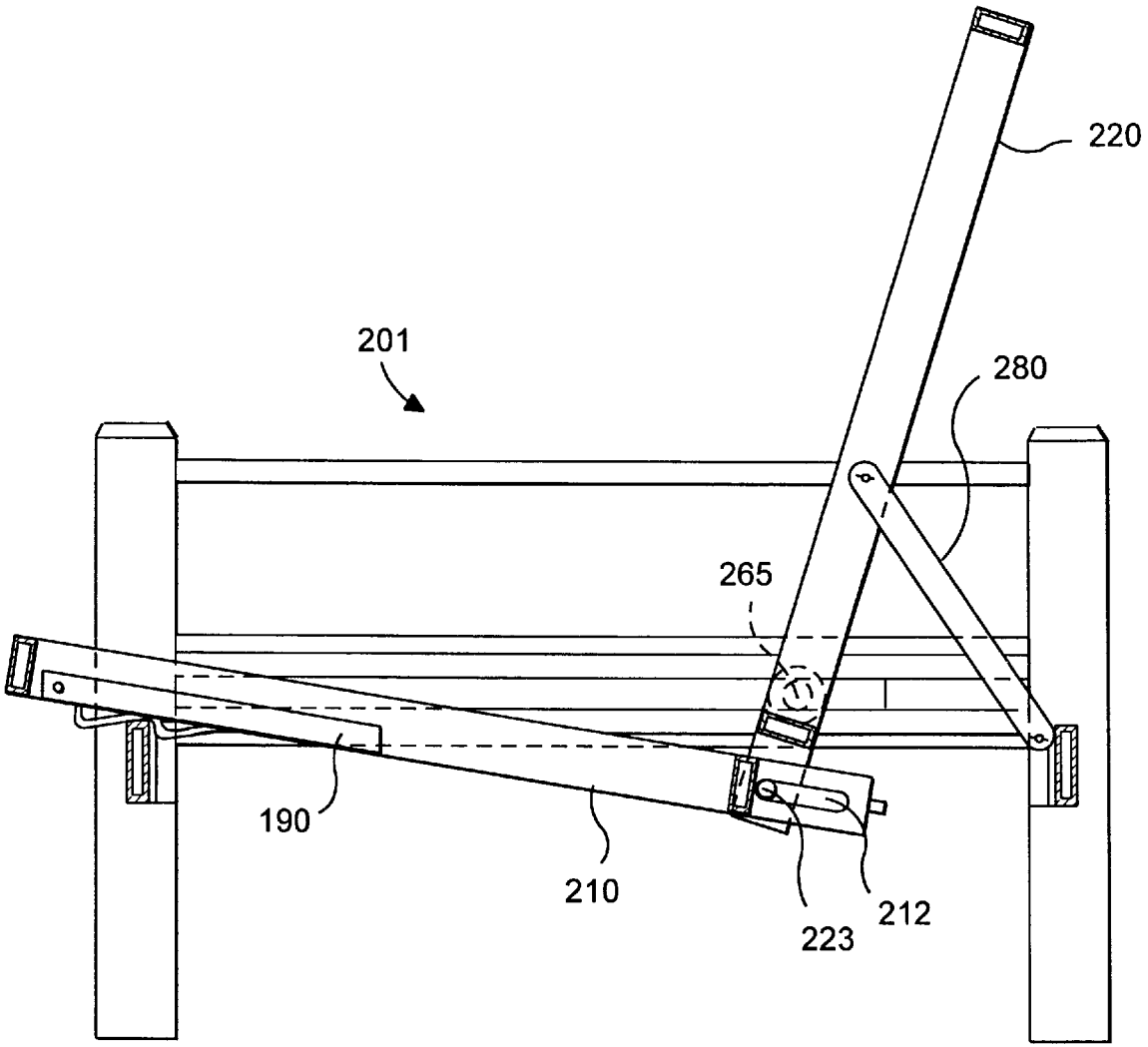
FIG. 36 is a side elevational sectional view with the futon locked in the back-rest position.

As the frame is pushed downward, the second pin 265 travels through the horizontal slot 250 into the extreme upper position as shown in FIG. 34. FIG. 35 shows the back frame 220 pivoted around the second pin 265 as the seat frame 210 is pushed upward. As can be seen from these figures, supports 280 are provided for the recliner 201. FIG. 36 shows the futon recliner as it is locked in the backrest position. This embodiment is preferably made of metal, although it is not limited to any type of material.

The terms and expressions which are employed are used as terms of description; it is recognized, though, that various modifications are possible.

It is also understood the following claims are intended to cover all of the generic and specific features of the invention herein described; and all statements of the scope of the invention which as a matter of language, might fall therebetween.

Having described certain forms of the invention in some detail, what is claimed is:

1. A sofa bed recliner having a sofa bed position and a recliner position comprising:

a back frame;

a seat frame;

a pair of arm frames connected to both sides of said recliner;

guide means disposed on each side of said recliner for reclining from a vertical position to a fully reclined position, said guide means including on each side of said sides of said recliner a vertical slot located in a vertically extending portion of said arm frame, a first portion extending from an upper portion of said back frame into said vertical slot; a horizontal slot located in a horizontally extending portion of the arm frame, a second portion extending from a lower portion of said back frame into said horizontally inclined slot;

said vertical slot having a portion enlarged to securely receive a vertical pin therein when said recliner is in its fully reclined position thereby preventing said recliner from jackknifing upward.

2. A recliner according to claim 1 wherein said horizontally inclined slot has a horizontal axis and has a portion which extends diagonally downward form said horizontal axis.

3. A recliner according to claim 1 further comprising counter absorbing elements fixedly connected to each side of said seat frame, each said counter absorbing elements abutting a bottom portion of each side of said back frame thereby relieving pressure on pins of guide means and distributing said pressure uniformly across said sides of said seat frame.

4. A recliner according to claim 3 wherein each of said counter absorbing elements is accurately shaped at each end abutting each said bottom portion of said back frame.

5. A recliner according to claim 1 further comprising:

dowels connected at a bottom portion of said back frame and openings in a portion of said seat frame opposite to said dowels to facilitate a locking engagement of said dowels into said openings when said recliner is in a fully reclined position.

6. A recliner according to claim 1 wherein a pair of supports are located behind said back frame.

7. A recliner according to claim 1 wherein said recliner is made of wood.

8. A recliner according to claim 1 wherein said recliner is made of metal.

9. A sofa bed recliner having a sofa bed position and a recliner position comprising:

a back frame;

a seat frame;

a pair of arm frames connected to both sides of said recliner;

guide means disposed on each side of said recliner for reclining from a vertical position to a fully reclined position, said guide means including on each side of said sides of said recliner a horizontal slot located in a horizontally extending portion of the arm frame, a second portion extending from a lower portion of said arm back frame into said horizontally inclined slot; support rods each having two ends, one end of each said support rods being pivotally connected to said arm frames and another end of each said support rod being pivotally connected to said back frame.

10. A recliner according to claim 9 wherein said recliner is made of metal.

11. A recliner according to claim 9 wherein said horizontally inclined slot has a horizontal axis and has a portion which extends diagonally downward form said horizontal axis.

12. A recliner according to claim 9 further comprising counter absorbing elements fixedly connected to each side of said seat frame, each said counter absorbing elements abutting a bottom portion of each side of said back frame thereby relieving pressure on pins of guide means and distributing said pressure uniformly across said sides of said seat frame.

13. A recliner according to claim 9 wherein each of said counter absorbing elements is accurately shaped at each end abutting each said bottom portion of said back frame.

14. A recliner according to claim 9 further comprising:

dowels connected at a bottom portion of said back frame and openings in a portion of said seat frame opposite to said dowels to facilitate a locking engagement of said dowels into said openings when said recliner is in a fully reclined position so that when said recliner is in its fully reclined position it is prevented from jackknifing upward.

15. A recliner according to claim 9 wherein a pair of supports are located behind said back frame.

16. A recliner according to claim 9 wherein said recliner is made of wood.

* * * * *